US007244216B2

(12) United States Patent
Rastegar

(10) Patent No.: US 7,244,216 B2
(45) Date of Patent: Jul. 17, 2007

(54) METHOD AND SYSTEM FOR PREVENTING POLE VAULT FALL INJURIES

(75) Inventor: Jahangir S. Rastegar, Stony Brook, NY (US)

(73) Assignee: Omnitek Partners LLC, Bayshore, NY (US)

( * ) Notice: Subject to any disclaimer, the term of this patent is extended or adjusted under 35 U.S.C. 154(b) by 304 days.

(21) Appl. No.: 10/406,954

(22) Filed: Apr. 5, 2003

(65) Prior Publication Data

US 2004/0198556 A1 Oct. 7, 2004

(51) Int. Cl.
*A63B 6/02* (2006.01)

(52) U.S. Cl. ..... 482/15; 482/18; 482/23; 182/138

(58) Field of Classification Search ..... 482/14–18, 482/23; 182/137–140, 70, 76, 88; 472/92
See application file for complete search history.

(56) References Cited

U.S. PATENT DOCUMENTS

| | | | | | |
|---|---|---|---|---|---|
| 480,139 | A * | 8/1892 | Ryan | 182/140 |
| 2,588,722 | A * | 3/1952 | Hendershott | 482/15 |
| 3,439,775 | A * | 4/1969 | Henrie et al. | 182/138 |
| 3,513,491 | A * | 5/1970 | Gordon | 482/15 |
| 3,948,351 | A * | 4/1976 | Baumann | 482/28 |
| 4,351,413 | A * | 9/1982 | Simon | 482/27 |
| 4,598,931 | A * | 7/1986 | Miyada | 280/749 |
| 5,052,065 | A * | 10/1991 | West | 5/424 |
| 5,150,767 | A * | 9/1992 | Miller | 182/137 |
| 5,226,672 | A * | 7/1993 | Husted | 280/749 |
| 5,592,705 | A * | 1/1997 | West | 5/424 |
| 5,832,547 | A * | 11/1998 | Burroughs | 4/504 |
| 6,314,596 | B1 * | 11/2001 | Neff | 5/420 |
| 6,594,835 | B2 * | 7/2003 | West | 5/424 |
| 2003/0051406 | A1 * | 3/2003 | Ritz et al. | 49/50 |
| 2004/0053747 | A1 * | 3/2004 | Bollinger | 482/15 |

FOREIGN PATENT DOCUMENTS

| | | | |
|---|---|---|---|
| DE | 3127596 | A1 * | 3/1983 |
| DE | 3931319 | A1 * | 3/1991 |
| EP | 138774 | A2 * | 4/1985 |
| FR | 2857878 | A1 * | 1/2005 |
| JP | 11226147 | A * | 8/1999 |

OTHER PUBLICATIONS

Nemoto, M., JP 11/226147 A, English language translation by computer, Aug. 1999.*

* cited by examiner

*Primary Examiner*—Jerome Donnelly
*Assistant Examiner*—Victor K. Hwang

(57) ABSTRACT

A method for preventing serious injuries to a person participating in a physical activity, such as pole-vaulting, which occurs at least partially over a hard surface. The method includes: detecting predetermined criteria indicative of a condition which requires deployment of the material into the deployed position; and moving a material from a retracted position to a deployed position upon detection of the predetermined criteria, wherein the material substantially does not impede the physical activity while in the retracted position and cushions the person from falling onto the hard surface while in the deployed position.

8 Claims, 21 Drawing Sheets

METHOD AND SYSTEM FOR PREVENTING POLE VAULT FALL INJURIES

BACKGROUND OF THE INVENTION

1. Field of the Invention

The present invention relates generally to safety and accident prevention, and more particularly, to methods and systems for preventing injuries associated with pole vault falls.

2. Prior Art

As shown in FIG. 1, in the sport of pole-vaulting, a jumper 10 runs to pick up speed, plants a pole 12 in a vault box 14 located just before a bar 16, gets to as great a height as possible with the aid of the pole 12, and attempts to clear the bar 16 and land on the relatively soft mat 18 positioned past the bar 16 and its supporting posts 20. Pole-vaulting is an inherently dangerous sport since the athlete may not clear the bar 16 and may land on hard surfaces 22 around the vault box 14 and the running path. Landing on these hard surfaces 22 is most dangerous if the athlete lands on his or her head. Landing on the shoulder or side is less dangerous, but may cause serious injuries since it may be from heights of several feet. Landing on the feet is usually least dangerous, but may still cause injury due to the height of the drop. In general, once the athlete 10 clears the bar 16, he/she lands over the relatively soft and thick mats 18 (such mats are also usually provided a few feet before the bar 16 on the sides of the running and vault box area), which can protect the athlete from injury if he/she should land in that particular area unless he/she should fall on the head.

In recent years, there has been a great amount of concern about injuries resulting from pole-vaulting. One suggestion has been to have the athlete wear a helmet. A helmet would provide a certain amount of protection if landing is, for example, on the back or on the side and the head is to hit a hard surface or member. However, a helmet does not provide protection from falls on or nearly on the head, which usually cause the severest types of injuries and which in some cases could be fatal. In addition, wearing of a helmet is very cumbersome and interferes with the sport itself and the athletes generally try to avoid wearing them. Also, helmets cannot be worn in the competitions and do not prevent injuries as a result of falls on the side or feet onto hard surfaces.

A need therefore exists for a method and system to prevent falling injuries in general, in particular in certain types of sports, and specifically in the sport of pole-vaulting. Such a device should, obviously be designed such that it would not impede the sport itself. The objective of the method and the system disclosed in this invention is to provide such methods and systems for preventing pole vault and other sports related injuries due to falls.

SUMMARY OF THE INVENTION

The basic method of this invention for preventing fall injuries in pole vault is based on deploying a safety soft landing material such as a net over the hard surface areas once the athlete has planted the pole in the vault box and is gaining height. The deployed safety soft landing material must obviously not interfere with the action of the pole while being handled by the athlete or with the athlete him or herself. In one embodiment of the present invention, the triggering mechanism that initiates the deployment of the safety soft landing material is located in the vault box and is activated by the pole. In another embodiment of the present invention, a sensor, for example an optical based sensor located near the bar posts senses an approaching athlete and triggers the deployment mechanism. In this and the previous embodiment, a delay is built into the deployment mechanism to allow enough time for the athlete to gain a certain height before deploying the safety soft landing means. In yet another embodiment of the present invention, a vision system tracks the athlete, and triggers the deployment mechanism once the athlete has gained a certain height. The vision system may also be programmed to only deploy the safety soft landing material if the athlete is about to or may fall over the hard surface areas. In yet another embodiment of the present invention, a trained observer who can foresee a fall over the hard surfaces would manually trigger the deployment of the safety soft landing material. In addition, other sensors may be positioned before and/or after the bar to check for the clearing of the hard surface area, and in case of failure to clear these areas to trigger the deployment of the safety soft landing material. The preferred triggering mechanism consists of more than one of the aforementioned triggering mechanisms in order to provide redundancy and minimize the possibility of malfunction or one of the triggering mechanisms missing a dangerous landing situation.

A similar safety soft landing material may be provided for deployment over the landing mats to prevent injuries during falls by the head. The preferred triggering mechanisms for deployment for such safety soft landing material are the aforementioned trained observer and/or the computer vision system.

Accordingly, an apparatus for preventing serious injuries to a person participating in a physical activity at least partially over a hard surface is provided. The apparatus comprising: a material being movable between deployed and retracted positions, wherein the material substantially does not impede the physical activity while in the retracted position and cushions the person from falling onto the hard surface while in the deployed position; detection means for detecting predetermined criteria indicative of a condition which requires deployment of the material into the deployed position; and deployment means for deploying the material over the hard surfaces upon detection of the predetermined criteria.

Preferably, the physical activity is pole-vaulting and the condition is a likelihood that the person will be injured by falling onto the hard surface.

In a first configuration, the material is at least one safety net. The hard surfaces preferably comprises a plurality of recesses for containing the safety net while in the retracted position.

Where the material is at least one safety net, the deployment means preferably comprises a plurality of elastic elements operatively connected to each of the at least one safety net, preloading means for preloading the plurality of elastic elements to retain the at least one safety net in the retracted position, and releasing means for releasing the preloading on the plurality of elastic elements to deploy the safety net into the deployed position.

Where the material is at least one safety net, the deployment means alternatively comprises a movable frame for retaining the safety net and means for moving the movable frame back and forth between the retracted and deployed positions. Preferably, the movable frame is at least one of rotatable and translational between the retracted and deployed positions.

In a second configuration, the material is preferably a plurality of cushioning elements. In which case, the deployment means preferably comprises a recess corresponding to each of the plurality of cushioning elements, wherein each of the plurality of cushioning elements are contained in a corresponding recess while in the retracted position, the deployment means further comprising means for extending the plurality of cushion elements from the recess and above the hard surfaces when in the deployed position. Preferably, the deployment means further comprises deploying a balloon from at least a portion of the plurality of cushion elements when the plurality of cushion elements are in the deployed position. Preferably, the deployment means further comprises means for connecting two or more the plurality of cushion elements together when in the deployed position.

In a first configuration, the detection means comprises an input from a trained observer, wherein the input triggers deployment of the material from the retracted position into the deployed position.

In a second configuration, the detection means comprises one or more sensors for detecting the predetermined criteria. Preferably, the one or more sensors comprises a vault box sensor operatively connected with a vault box for detecting the insertion of a pole therein for use in pole-vaulting.

In a third configuration, the detection means comprises a computer recognition system for detecting the predetermined criteria.

Also provided is an apparatus for preventing serious injuries to a person participating in pole-vaulting at least partially over a hard surface. The apparatus comprising: a material being movable between deployed and retracted positions, wherein the material substantially does not impede the pole-vaulting while in the retracted position and cushions the person from falling onto the hard surface while in the deployed position; and deployment means for deploying the material over the hard surfaces upon detection of the predetermined criteria.

The apparatus preferably further comprises detection means for detecting predetermined criteria indicative of a condition which requires deployment of the material into the deployed position.

The apparatus alternatively further comprises a sensor for inputting the deployment means. Preferably, the sensor comprises a vault box sensor operatively connected with a vault box for detecting the insertion of a pole therein for use with the pole-vaulting.

Still provided is a method for preventing serious injuries to a person participating in a physical activity at least partially over a hard surface. The method comprising: detecting predetermined criteria indicative of a condition which requires deployment of the material into the deployed position; and moving a material from a retracted position to a deployed position upon detection of the predetermined criteria, wherein the material substantially does not impede the physical activity while in the retracted position and cushions the person from falling onto the hard surface while in the deployed position.

Still yet provided is a vault box for use in pole-vaulting. The vault box comprising: a cavity for insertion of a pole therein; and a switch disposed in the cavity for detection of insertion of the pole in the cavity and for outputting a signal indicating the insertion of the pole.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

Although this invention is applicable to numerous and various types of dangerous activities for which a safety system is useful, it has been found particularly useful in the environment of sports and more particularly in the environment of pole vaulting. Therefore, without limiting the applicability of the invention to sports and pole-vaulting, the invention will be described in such environment.

Figure 1:
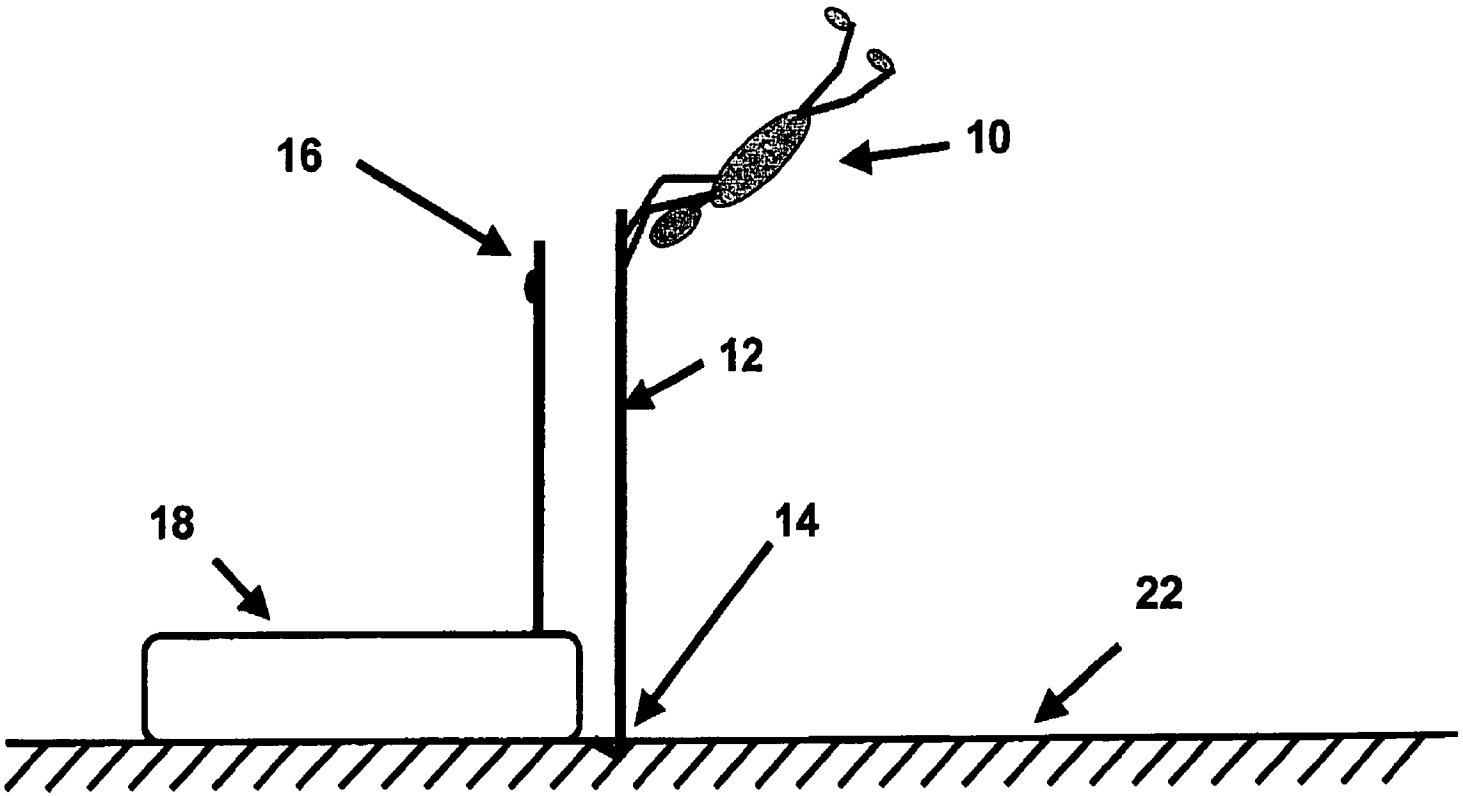
FIG. 1 illustrates a side view of a pole vault of the prior art having a vaulter attempting to jump over a high bar.
Figure 2:
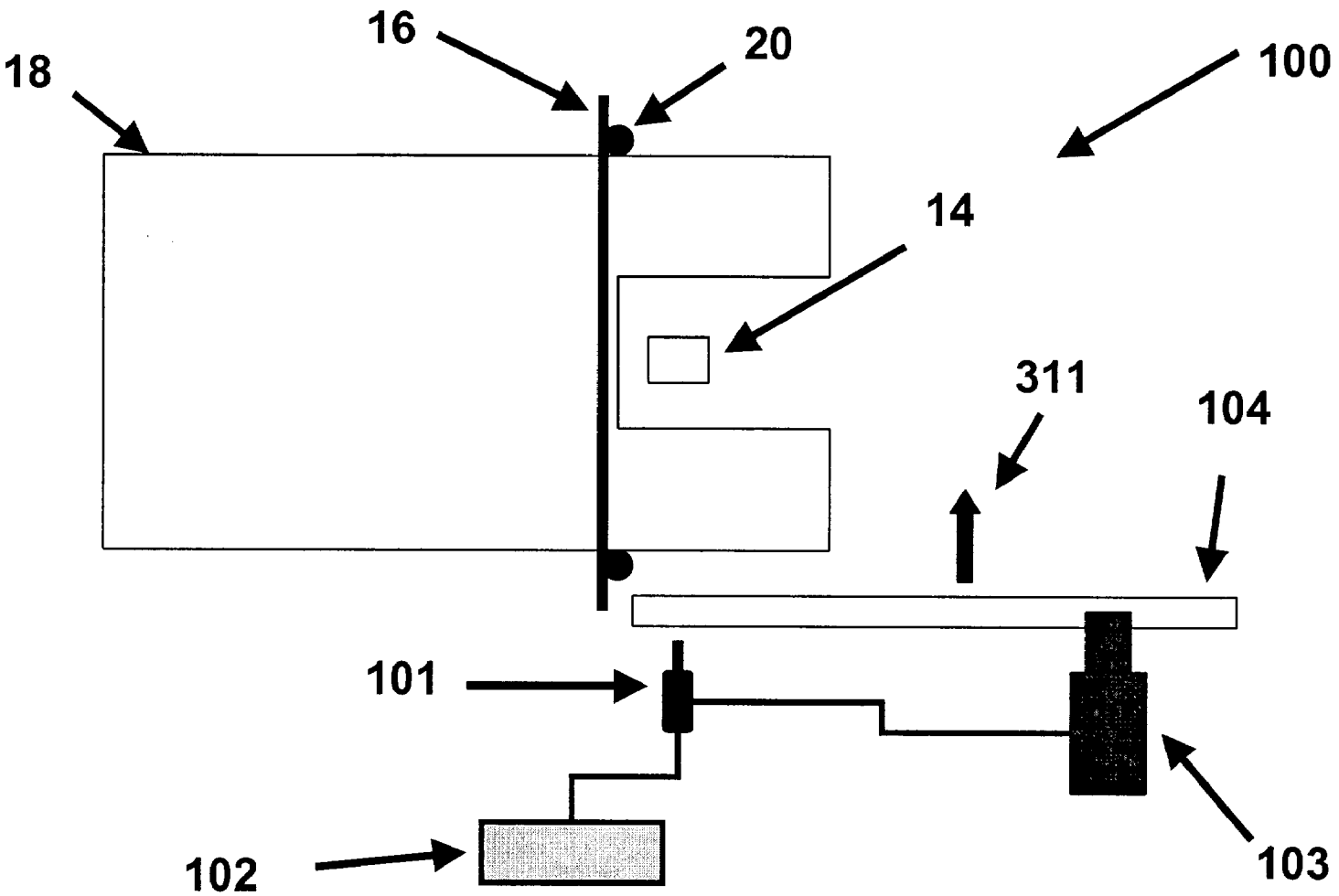
FIG. 2 illustrates a plan view of a first preferred implementation of a pole vault system of the present invention having a deployable safety net over the hard surfaces in front of the high bar.

Referring now to FIG. 2, the major components of a preferred implementation of a fall safety system 100 for preventing fall injuries in pole-vaulting is shown schematically therein. The basic preferred system 100 consists of one or more sensors 101 (which may be a trained observers) that detects the position and/or posture of the athlete during the jumping event to determine whether and/or when a safety net 104 needs to be deployed. The sensory component 101 preferably contains redundancy to minimize the chances of faulty sensory action, particularly, the faulty action corresponding to not triggering a deployment mechanism 103 when a dangerous falling situation has arisen. To minimize the chances of such an event occurring, and since a trainer or coach is almost always required to be present during training, the safety net deployment mechanism's 103 triggering signal generated by the trained observer is usually the preferred primary or redundant sensory signal.

The sensory component 101 provides a signal to the safety net deployment triggering mechanism and control unit 102, indicating the occurrence of an event which is to be used by the triggering mechanism 102 to determine the deployment time. The time of receiving the triggering signal may not be the same as the time that the deployment of the safety net 104 has to be initiated. This is the case when the sensory signal corresponds to an event prior to the athlete raising himself/herself to a considerable height that is either required by the deployed safety net 104 or can result in a dangerous fall. For this reason and for such sensory devices, the triggering mechanism 102 is usually constructed with a programmed delay to allow for the time between the moment that the sensory signal is received and the time at which the safety net 104 has to be deployed. Preferably, the triggering mechanism 102 is constructed with a processor that is readily programmed to accept different sensory inputs and related parameters, such as the location of the sensor 101 relative to the rod 16 and its posts and the runway and the required delay for each sensor 101 and athlete. The aforementioned amount of time may be set to different levels depending on the level of expertise of the athlete, since beginners may not be able to achieve as high heights as the more trained pole-vaulters. The delay may also be computed from a detected trajectory of the athlete using a computer vision system. The triggering mechanism 102 is connected to the deployment mechanism 103, which receives the triggering signal from the triggering mechanism 102 and activates the deployment mechanism 103. The deployment mechanism 103 in turn deploys the safety net 104. In general, there is more than one safety net 104 to be deployed. Preferably, at least two such safety nets 104 are positioned on each side of the runway track and the rod posts 20. One of the main reasons for having more than one safety net 104 is to achieve faster deployment. The reason for deploying safety nets 104 from both sides of the runway is to minimize the complexity of the safety net design and deployment procedure to avoid interference with the pole as the athlete is using it to achieve height to carry him/her over the rod 16. Each safety net 104 would generally require one deployment actuation mechanism 103. In certain configurations of the safety nets 104, it may be desired to deploy certain safety nets sequentially. For the sake of simplicity, only one safety net 104 and deployment mechanism 103 is shown in FIG. 2. All deployment mechanisms 103 are triggered with the same triggering mechanism 102. It is, however, possible to equip a pole vault site with more than one such fall prevention system for added safety and/or for deployment by an independent sensory system.

Figure 3:
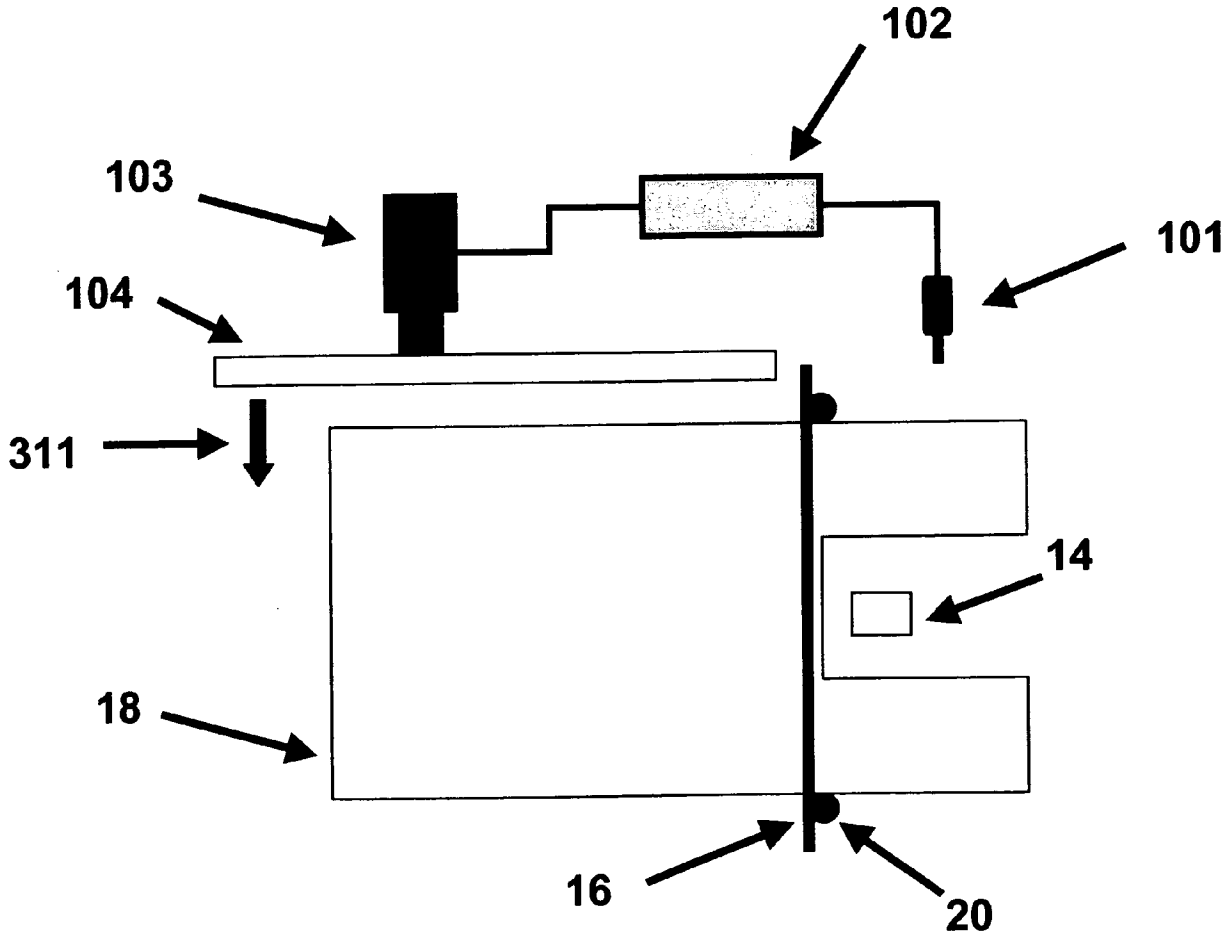
FIG. 3 illustrates a plan view of a second preferred implementation of a pole vault system of the present invention having a deployable net over the mat behind the high bar.
Figure 23:
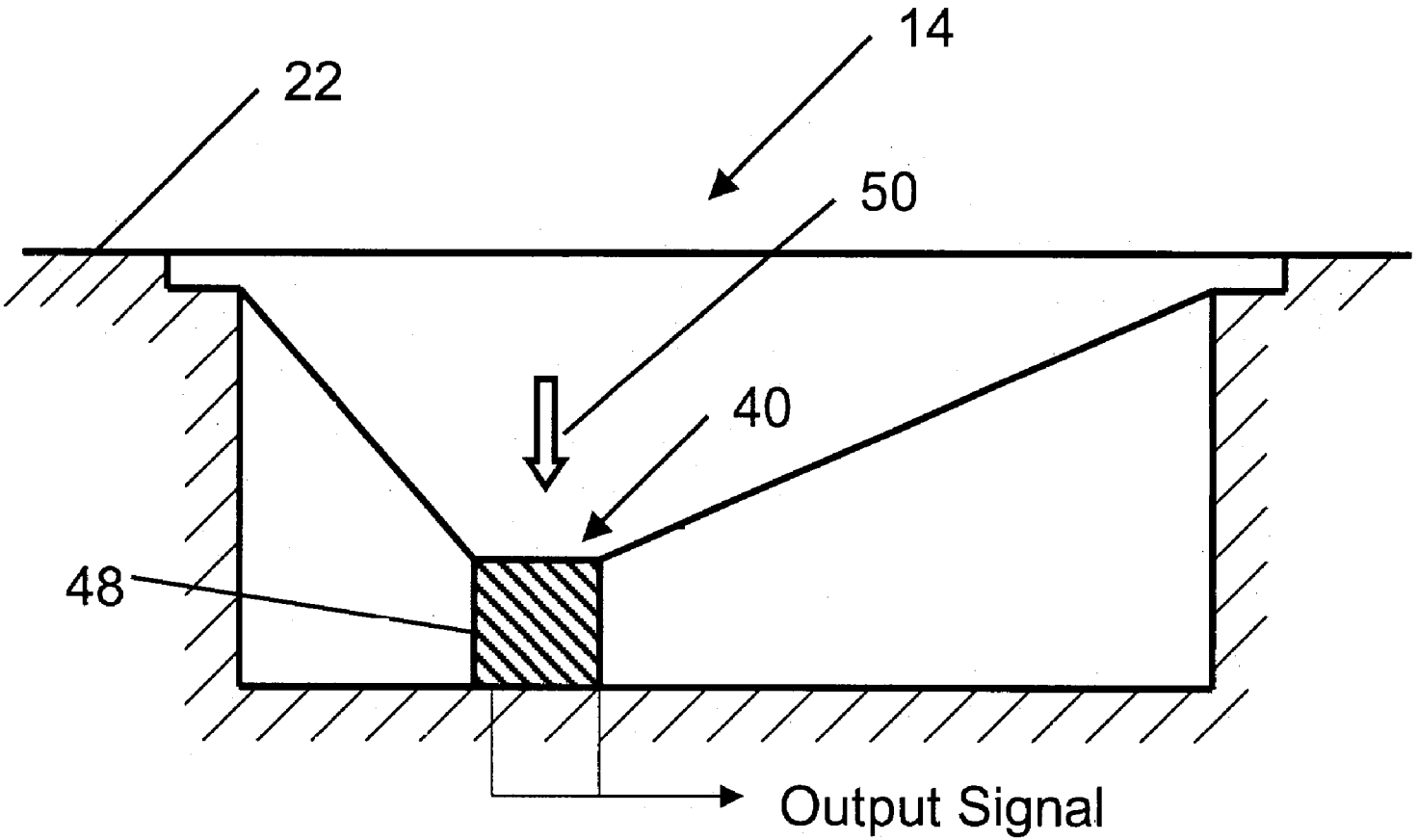
FIG. 23 illustrates a sectional view of a preferred implementation of a vault box of the present invention.

A fall safety system 100 may also be installed behind the jump rod to deploy over the existing mats as shown in FIG. 3. Here, the primary purpose for the safety net 104 is to prevent injury during head landing situations. For this reason, the preferred sensory input is from a sensor 101 in the form of a computer vision system, which determines the potential danger and sends a signal to the triggering mechanism to deploy the safety net. Another preferred implementation is where a trained observer, such as the athlete's coach, generates sensory input. The best protection is provided when both of the above sensory information is provided simultaneously. There is always an option of providing, deploy the safety net before the jump, or deploying a safety net during all jumps. However, if the jump is good and safe, the athletes may prefer to land on the mat rather than on the safety net.

Where the safety net 104 is deployed during all jumps, a sensor is preferably used to detect that a pole vault event has occurred. Such a sensor may also be used to "arm" the system and to look for the possibility of a dangerous fall occurring. While a manual operator (or trained observer) can be utilized for such a purpose, it is preferred that the pole vault event is automatically detected and the safety net deployed accordingly. The pole vault event can be detected by a computer vision system or by activation of a switch in the pole vault box 14, as shown in FIG. 23. FIG. 23 shows a pressure sensitive switch 40. When the pole 12 is planted by the athlete in the vault box 14 the pressure exerted by the weight of the athlete on the pressure sensor 48 generates circuit and output a signal indicating a pole vault event is occurring. The output signal is then input directly to the triggering and/or deployment mechanisms 102, 103 or indirectly through a processor or the like.

One major advantage of the disclosed pole vault fall safety system is that it can be used for athletes of various skills, from beginners to the highly skilled, noting that accidents also happen with the highly skilled athletes. Unlike helmets, the deployed safety net does not interfere with the athlete's routine and the pole, while protecting the athlete from any type of dangerous fall situations.

Figure 4:
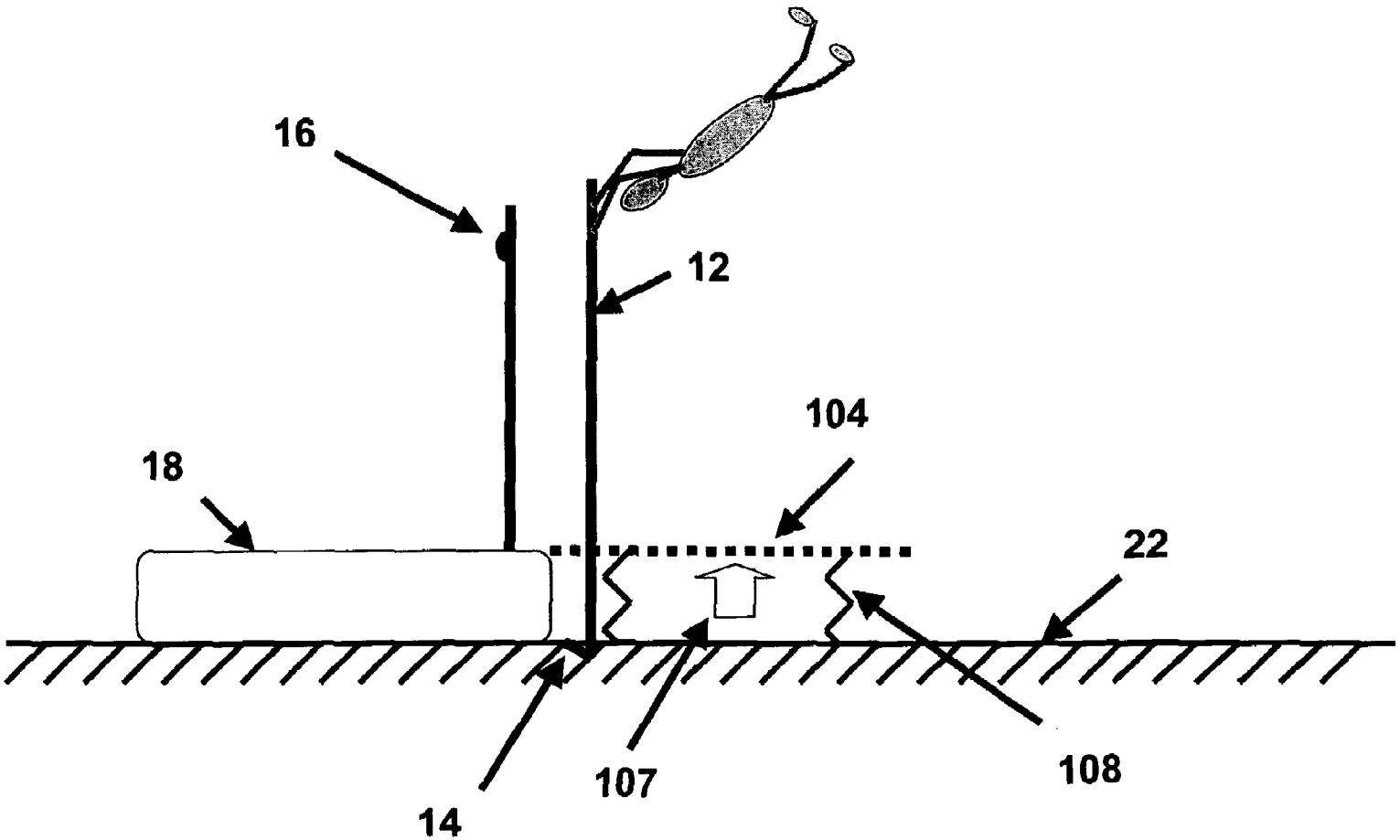
FIG. 4 illustrates a side view of a third preferred implementation of a pole vault system of the present invention having a deployable net embedded in spaces provided in the hard surfaces in front of the high bar.

The safety net 104 shown in FIG. 2 is deployed from the sides of the surfaces that are intended to be covered. In another embodiment of this invention, the safety net 104 is embedded inside the recessed regions provided in the hard surface 22 areas to be covered. The safety net 104 is preferably positioned in narrow pathways deep enough to clear the hard surfaces 22 where the athlete runs over it. The safety net is preferably deployed by preloaded spring elements 108, which are held in place by a locking mechanism (e.g., a latch), which is released by the safety net deployment mechanism 103, which is activated by the triggering mechanism 102 once an appropriate signal is received from the sensory device 101. The position and direction of deployment of the safety net 104 of this embodiment is shown schematically in the side view of FIG. 4. The safety net 104 is embedded in relatively narrow spaces provided inside the hard surfaces 22, from which the athletes are to be protected. The safety net 104 is deployed by the preloaded springs 108 (shown in their deployed position) in the direction 107 from the "stored" position. Some or all of the springs 108 serve two different purposes. Firstly, they are used to deploy the safety net 104 as described above. Secondly, they provide for the required elasticity of the safety net 104 to provide for a cushioning effect in case of an athlete falling over the hard surfaces 22. In the schematic illustration of FIG. 4, the sensory device, triggering mechanism and the deployment mechanisms are not shown for clarity but are considered to be present. In the illustration of FIG. 4 and for the sake of simplicity, the safety net 104 is shown to be supported solely by the preloaded deployment springs 108. Alternative methods of supporting the safety net relative to the ground are described later. In the remainder of this description, the term deployment spring is used without intending to limit the choice for this component of the system to only one alternative. Thus, the deployment springs 108 can be any elastic elements.

Figure 5:
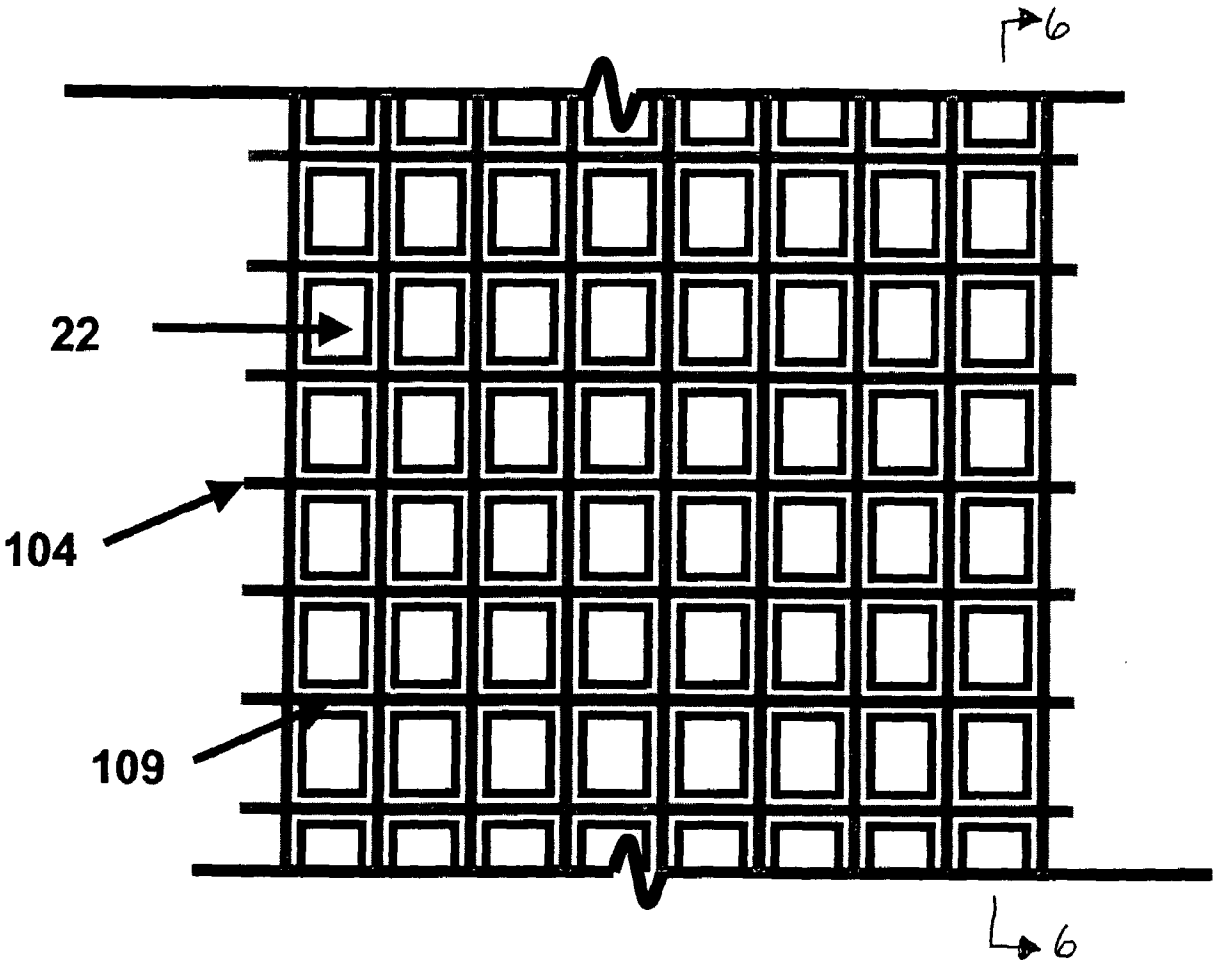
FIG. 5 illustrates a plan view of a segment of the hard surfaces having a recessed safety net of FIG. 4.

The top view of a section of the hard surfaces where the safety net of FIG. 4 is embedded in the recessed spaces is shown in FIG. 5. In this illustration, only a portion of the hard surfaces 22 are shown for simplicity while it should be noted that the safety net 104 of this embodiment is intended to cover all hard surfaces 22 where an athlete may fall onto during an unsuccessful jump.

In FIG. 5, square woven shaped or patterned safety nets 104 are shown by way of example only. It should, however, be noted any other net designs and configurations may also be used and that by the choice of squarely woven nets for FIG. 5 it is not intended to limit this embodiment to such net shapes and designs. In this schematic, the net 104 is shown to be positioned within the recessed spaces 109 provided in the hard surface 22 areas. In this view, the preloaded deployment springs 108 are not shown.

Figure 6:
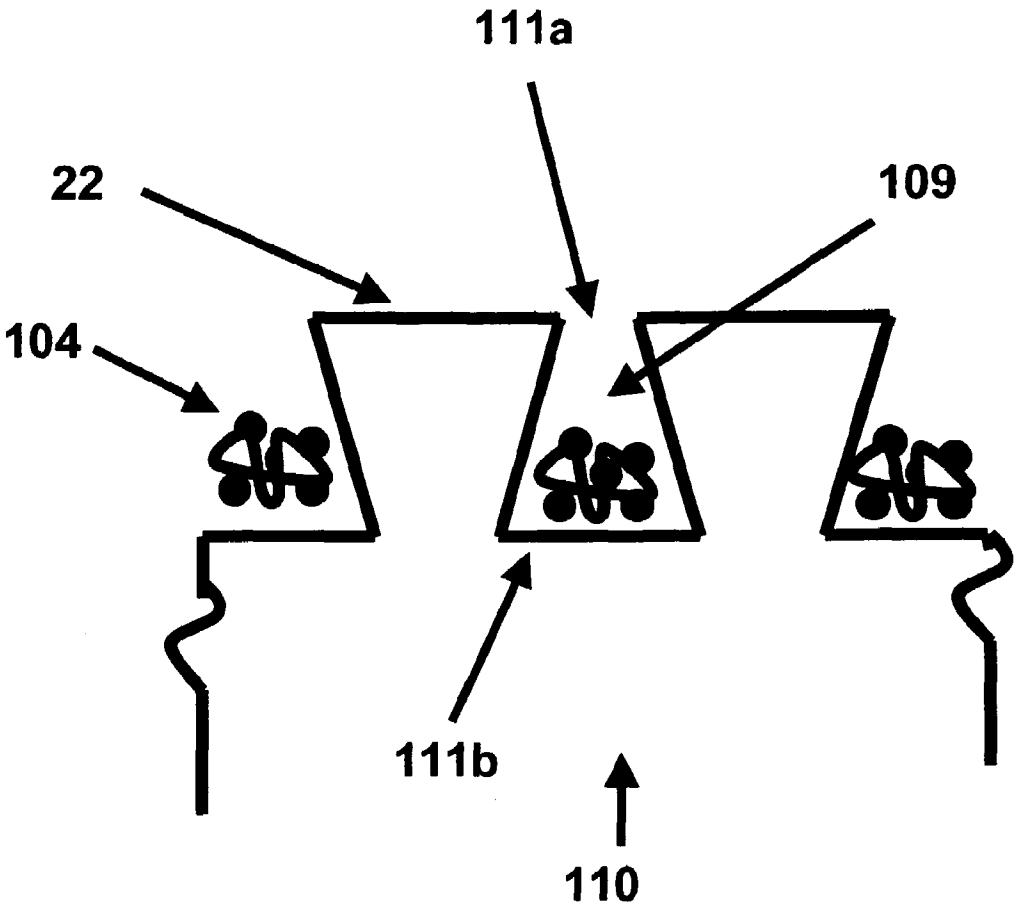
FIG. 6 illustrates a sectional view of the segment of the hard surfaces of FIG. 5 as taken along line 6—6 therein.

FIG. 6 is cross-section 6—6 of a portion of FIG. 5, showing the profile of a typical recessed space for embedding the safety net 104. For the sake of simplicity, the deployment springs 108 are not shown. The recess space 109 is shown with its top portion 111*a* (also referred to as surface openings). The recessed section of the hard surface 22 area is usually constructed over a solid foundation 110. However, the recessed spaces 109 may be provided in a mat and placed over the foundation 110 so as to be portable. The safety net 104 is then stored in the recess space cavity for deployment. In some portions of the recessed space 109, a relatively large portion of the safety net 104 may be stored. However, the safety net 104 is preferably distributed relatively uniformly in the recessed spaces 109 over the hard surface 22 to be protected. By achieving a more uniform distribution of the safety net 104 in the recessed spaces 109, the total distance that they have to travel to reach their designated deployed position is minimized, thereby making it possible to achieve rapid deployment.

The recessed space 109 may be constructed with any geometrical spatial shape. In general, it is desired that the recessed space 109 to have the smallest possible opening on the surface for minimal surface disturbance but have adequate volume for the storage of the safety net 104 and its easy and rapid deployment, which means minimal contact friction. Since it is preferred that the system be reusable (as opposed to a single use), the surface openings 111*a* must, however, be large enough to allow easy and rapid "fold-back" and storage of the safety net 104 into the recess spaces 109. Thus, as shown in FIG. 6, it is preferred that the recess space 109 taper outward in cross-section away from the surface openings 111*a* towards a wider bottom surface 111*b*.

Figure 7:
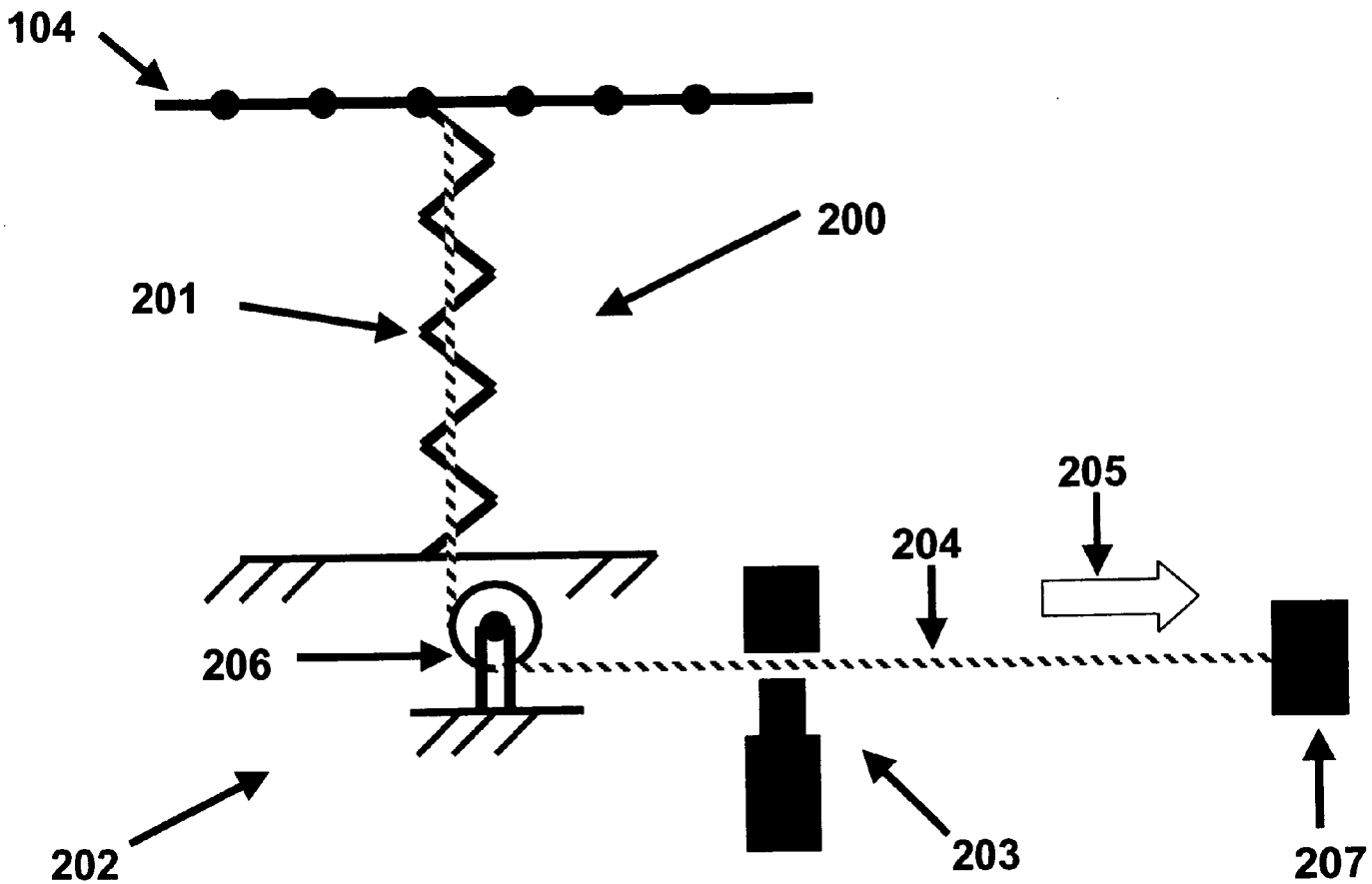
FIG. 7 illustrates a schematic of a first deployment mechanism for deploying the safety net.

In one embodiment of the present invention, the springs 108 are distributed more or less uniformly under the entire area of the safety net 104. At least a portion of the springs 108 are constructed as deployable spring units 200 consisting of one or more elastic elements 201 (one of which is shown in FIG. 7), hereinafter referred to simply as springs, which are preferably tensile or buckling type of springs. Other types of springs, such as those working in bending, torsional or compressive modes may also be used. As would be appreciated by those familiar with the art, springs working with the combination of any number of above modes may also be constructed with or without appropriate linkage, cable and/or other types of mechanisms to perform the required function, i.e., the function of potential energy storage (preloading) and safety net 104 deployment by releasing part or all of the said potential energy. In the schematic drawing of FIG. 7, the elastic elements are shown in the deployed position of the safety net 104.

Each spring unit 200 is equipped with a preloading mechanism consisting of a mechanism 202 for preloading the springs 201 as the safety nets 104 are pulled into their storage spaces 109, and a locking mechanism 203 which locks the springs 201 in their desired preloaded position. In one embodiment of the present invention, the preloading mechanism consists of a cable 204, which is pulled in the direction 205 by an actuator 207 through a pulley system 206 to preload the spring 201 to pull back the safety net 104 into its stored position in the aforementioned recessed spaces 109. The elastic element 201 and the pulley system 206 are both grounded as shown in FIG. 7. In one embodiment of the present invention, the cable 204 is pulled by an electrical motor, which winds the cable over a drum until the safety net 104 is in its fully stored position and a limit switch (not shown) is triggered. In another embodiment of the present invention, the cable 204 is pulled by an air cylinder and its operating valve is switched off when the safety net 104 is at its intended stored position by a similar limit switch (not shown). The locking mechanism 203 is preferably normally locked (by a "braking" spring) and is unlocked only when its unlocking actuation mechanism is energized to deploy the safety net 104. The locking mechanism 203 may be operated electrically or pneumatically. In general, when the cable 204 is pulled by an electric motor, the locking mechanism 203 is desired to be operated electrically. When the cable 204 is pulled by a pneumatic cylinder, then the locking mechanism 203 is desire to be operated pneumatically. The same is true for the corresponding limit switches. It is obvious to those familiar with the art that the mass of all the moving parts of the spring unit 200 as well as the safety net 104 has to be minimized in order to achieve minimal deployment time as well as to impact load on the athlete during a fall. To achieve minimum mass, the preloading mechanism 202 is preferably constructed by a lightweight tension cable, preferably a high tensile strength woven fabric type.

The stiffness and the deployed height of the spring elements 201 must be appropriate to ensure that the heaviest athlete falling from the maximum height would not deflect the safety net 104 to the hard surfaces 22 but leave certain distance for the sake of safety. The spring elements 201 may have linear or nonlinear load-deflection characteristics and may be at their free length (no stored potential energy) or with certain level of preloading in their deployed position. In the preferred embodiment of the present invention, the spring elements 201 have nonlinear load-deflection characteristics so that the athlete impact with the safety net is initially softer and as the spring elements are deflected further they exhibit higher stiffness to limit the total free height required under the safety net 104 in its deployed position. The purpose of the initial preloading is to also minimize the total free height that is required under the safety net 104 in its deployed position. The amount of preloading must, however, be limited to limit the maximum impact and resistance force that is imparted on the athlete during a fall to avoid injury. In the schematic drawing of FIG. 7, the elastic elements 201 are shown to be deployed in the vertical direction. It is, however, appreciated that the elastic elements 201 may be deployed from any direction and in fact it may be deployed in a bending or torsional modes with or without other assisting linkage or other types of mechanisms.

Figure 8:
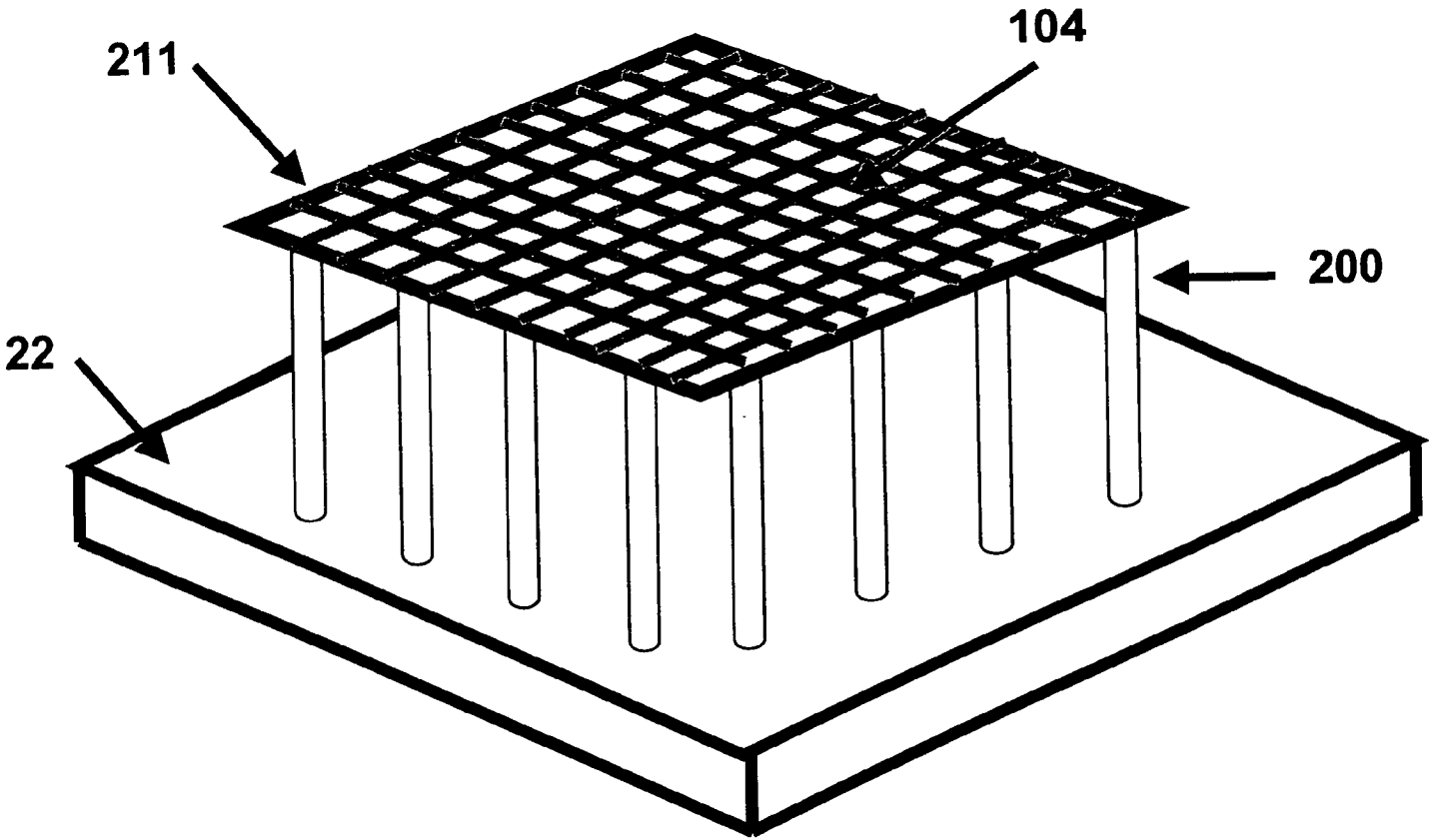
FIG. 8 illustrates a schematic of a framed safety net deployed by the deployment mechanism of FIG. 7.

In another embodiment of the present invention, the safety net 104 is stored as shown in FIG. 6, with its outer edges attached to an enclosing frame 211, as shown in FIG. 8. In its stored position, the safety net 104 and the enclosing frame 211 are both brought down by the deployment mechanism into the recessed spaces 109 (recessed areas are not shown in FIG. 8 for clarity) in the hard surfaces by the deployable spring units 200. For relatively small safety nets 104, the deployable spring units 200 need only be used for the deployment of the frame 211. Regular elastic elements 201 may, however, still be required to be distributed under the safety net area to provide the desired amount of elasticity adequate for cushioning of a fall. For relatively small safety nets 104, the deployment of the frame 211 will automatically deploy the safety net 104. However, for larger safety nets 104, additional spring units 200 may be used throughout the inner regions of the safety net 104 to prevent the safety net 104 from being pushed to the side or remaining outside the aforementioned recess spaces 109, above the hard surfaces 22.

Figure 9:
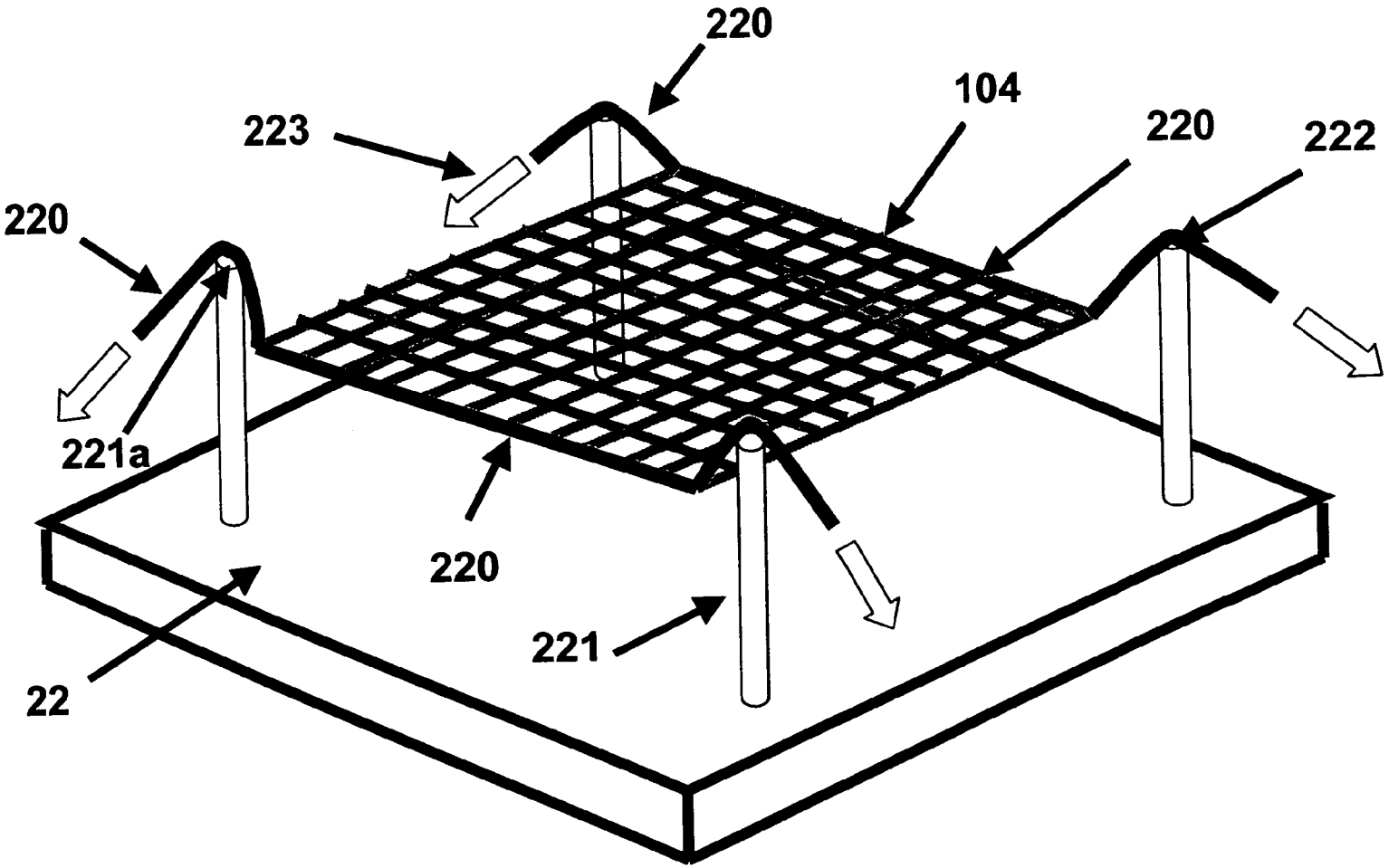
FIG. 9 illustrates a schematic showing a safety net deployed by cables.

In yet another embodiment of the present invention, the safety net 104 is stored in the aforementioned recessed spaces 109 of the hard surfaces 22 as shown in FIG. 6, with at least two opposing edges of the safety net 104 being attached to two separate cables 220, which are used to deploy the safety net 104. The deployed safety net 104 and its deployment cables 220 are schematically shown in FIG. 9. The cables 220 are supported by columns 221 and run preferably over pulleys 222 attached to a free end 221*a* of the columns 221. In its stored position, the safety net 104 and the cables 220 are both stored in the recessed spaces 109 (recessed areas are not shown in FIG. 9 for clarity) in the hard surfaces 22. The cables 220 may be pulled down from its deployed (raised) position and kept secure in its stored position by a mechanism such as the spring units 200, while the cables are released in the direction opposite to the directions 223. For relatively small safety nets 104, deployable spring units 200 need only be used on the cables along the edge of the net. Regular elastic elements 201 may, however, be required to be distributed under the safety net area to provide the desired amount of elasticity adequate for cushioning of a fall. Pulling the cables 220 in the direction of the arrows 223 deploys the safety net 104. For relatively small safety-nets 104, the deployment of the cable 220 will automatically deploy the safety net 104. However, for larger safety nets 104, additional spring units 200 may be used throughout the inner regions of the safety net 104 to prevent the safety net 104 from being pushed or remaining outside the aforementioned recess spaces 109, above the hard surfaces 22. Alternatively, the cables 220 may be fixed to the free end 221*a* of the support columns 221. The support columns 221 would then be pulled down into the ground by an actuation mechanism, preferably pneumatic cylinders to store the safety net 104 below the hard surfaces 22 in the recessed spaces 109. The safety net 104 is then deployed by pushing the support columns 221 out of their stored position and thereby raising the cables 220 and with it the safety net 104. At least some portions of the cable 220 are preferably elastic to assist in cushioning the fall of an athlete over the safety net 104.

Figure 10:
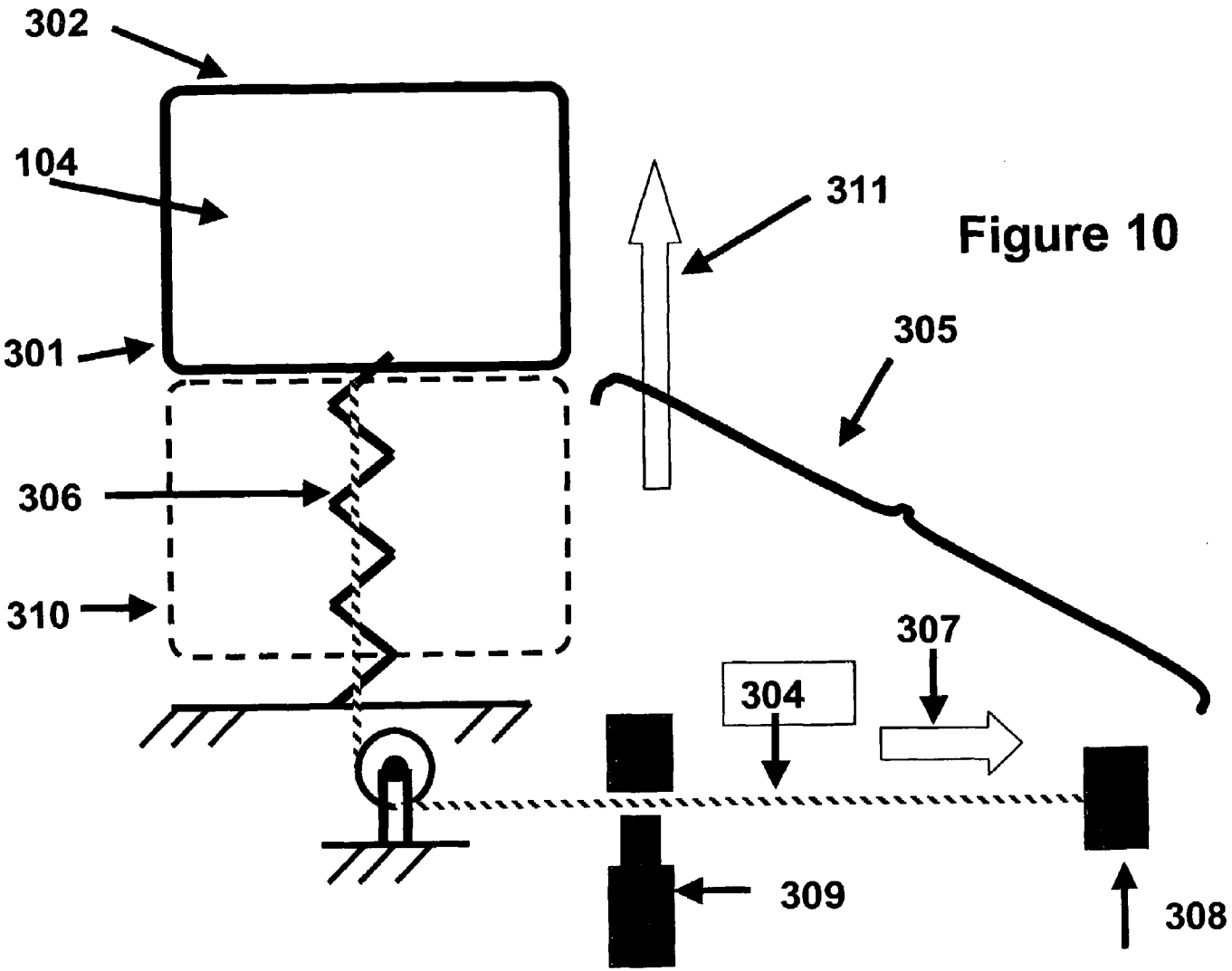
FIG. 10 illustrates a plan view of another preferred implementation of a safety net deployment system, wherein the safety net is deployed by a translational movement.
Figure 11:
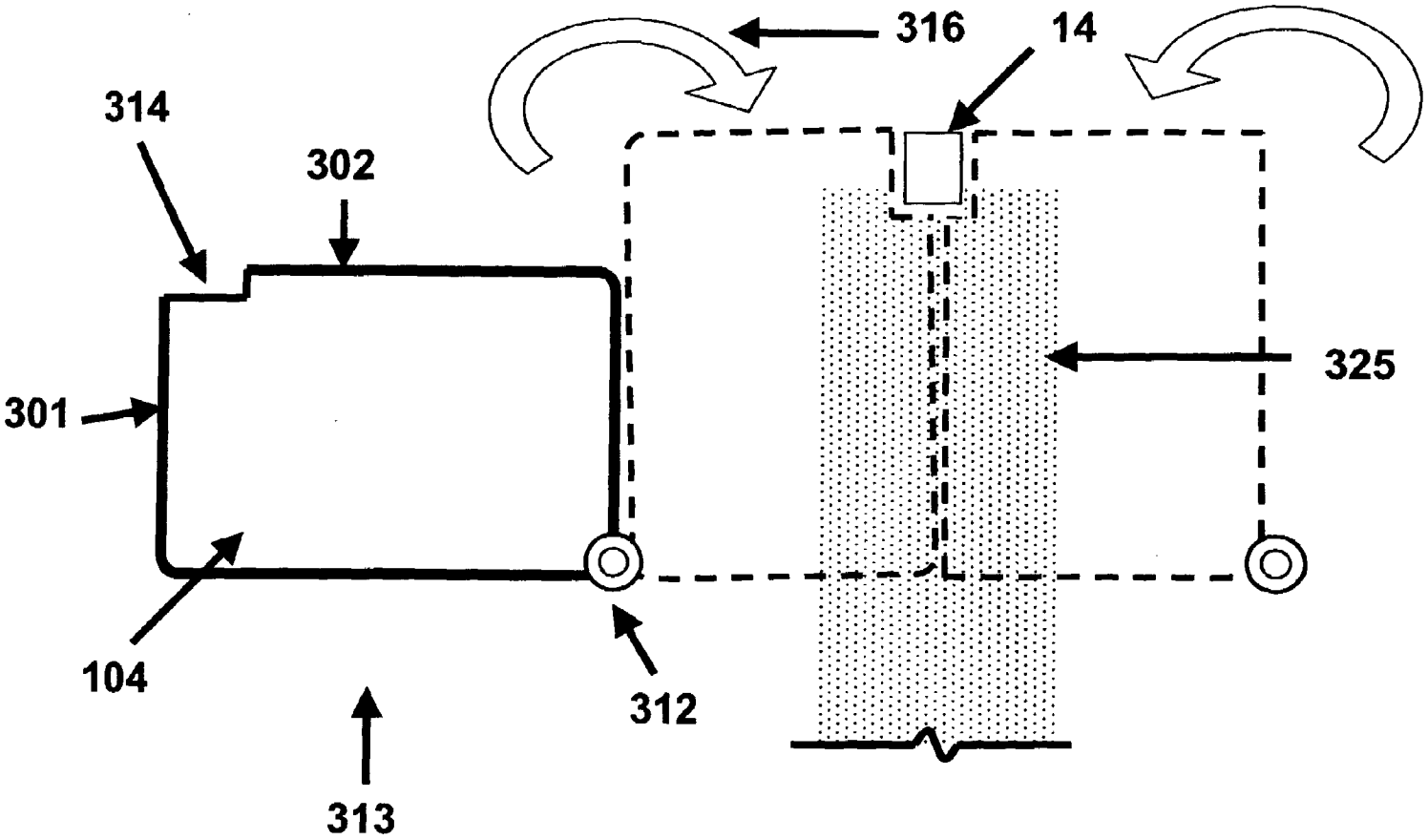
FIG. 11 illustrates a plan view of a variation of the safety net deployment system of FIG. 10, wherein the safety net is deployed by a rotational movement.

In the embodiments shown in FIGS. 2 and 3, the safety net(s) 104 are deployed by an actuation mechanism 103, which operates in a manner similar to that shown in FIG. 7. In FIGS. 2 and 3, the safety net 104 is shown in its retracted position. It is preferred that the safety net 104 is fixed to a frame 301, preferably by relatively elastic elements not shown. In FIG. 10, the safety net 104 is shown in its deployed position over the hard surfaces 22 that the athlete may fall on. One side 302 of the frame 301, i.e., the side that deploys towards the vault box area, is preferably elastic to prevent injury in case of impact with a bystander or the athlete. The other three sides of the frame 301 are preferably relatively rigid to allow the safety net 104 to effectively support a load. The deployment mechanism 305 (103 in FIGS. 2 and 3) deploys and retracts the frame 301. In one embodiment of the present invention, the deployment mechanism 305 is constructed with a lightweight cable 304, which is used to preload an elastic element 306, preferably by pulling the cable 304 in the direction 307 by an actuator 308. The actuator 308 may be electrically or pneumatically driven as described for a previous embodiment. A locking mechanism 309 is used to lock the cable 304 to lock the elastic element 306 in its preloaded position. Once the triggering signal is given by the triggering mechanism 102, the locking mechanism 309 releases the cable 304, and the potential energy stored in the preloaded elastic element(s) 306 is used to deploy the frame 301 and together with it the safety net 104. The deployment of the safety net frame 301 may also be assisted by a hanging weight (not shown) and/or an active actuation mechanism (not shown) such as a pneumatic cylinder. In FIG. 10, the safety net 104 is shown with dashed lines in its stored position 310. The safety net 104 is then deployed in the direction 311 to cover the hard surfaces 22. In the embodiment shown in FIG. 10, the safety net 104 is deployed by a pure translational motion in the direction 311. Alternatively, the safety net may be rotated about a fixed pivot 312, as shown in FIG. 11, in the direction 316, from its stored position 313 (dashed lines) to its deployed position 314 by the deployment mechanism 305. Alternatively, the safety net 104 may be brought to its deployed position from its stored position by a combination of translation and rotation by a linkage mechanism 317, as shown in FIG. 12, preferably using a preloaded elastic element similar to that of 305.

Figure 12:
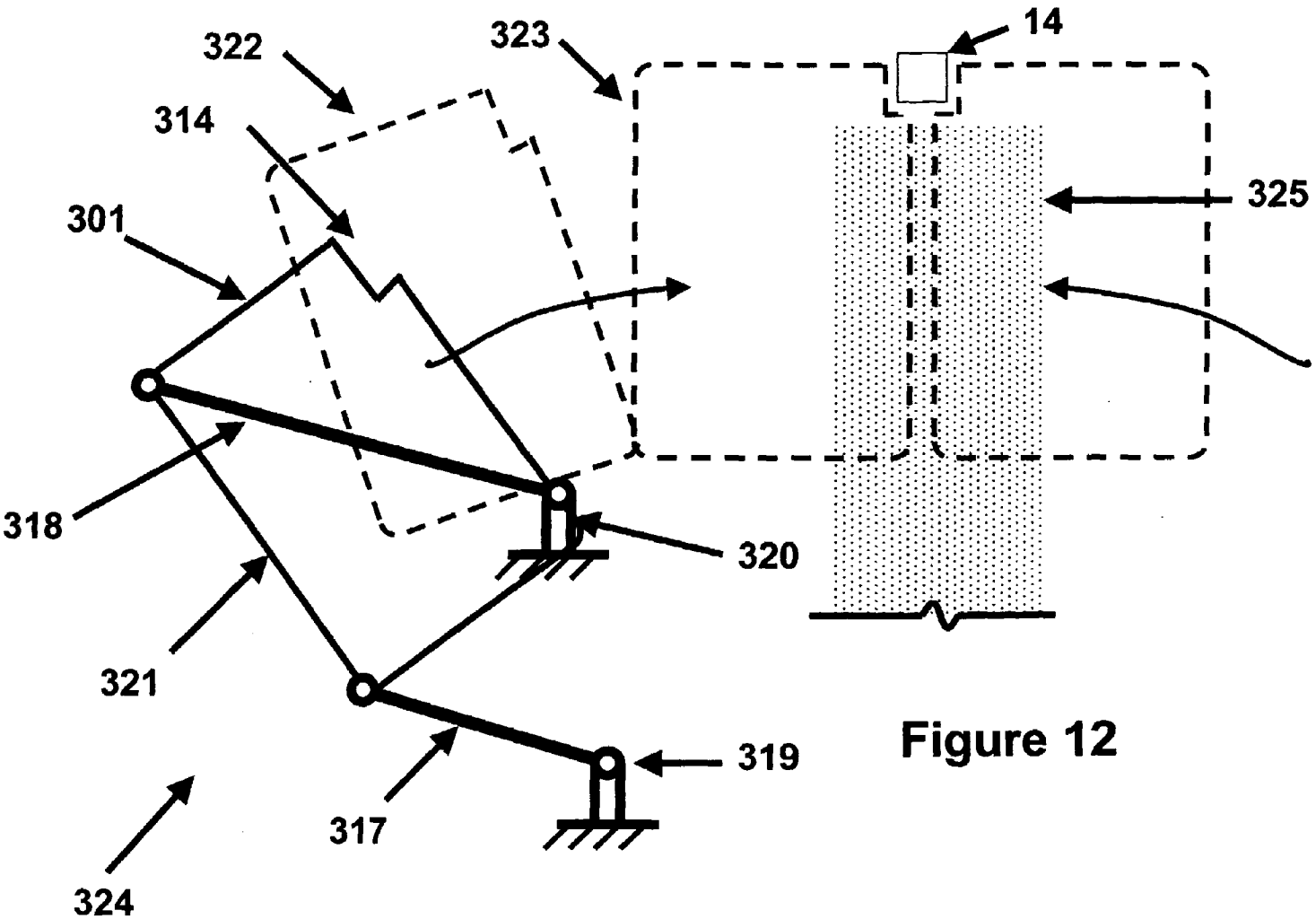
FIG. 12 illustrates a plan view of another variation of the safety net deployment system of FIG. 10, wherein the safety net is deployed by a rotational movement and translational.

In the preferred embodiments of this present invention shown in FIGS. 10–12, two or more safety nets 104 are employed from opposite sides over the hard surfaces 22 to reduce the time needed for their deployment and to allow the deployment of the safety net around the pole (with the provided recessed area 314 in the safety net 104) but very close to it to prevent a falling athlete from going through the opening and hitting the hard surfaces 22, FIG. 11. The recessed area 314 is provided in all the safety nets 104 that are deployed around the pole area (not shown in other schematics for clarity reasons).

In another embodiment of the present invention, the frame 301 (with safety net 104 attached thereto) is deployed, preferably by a linkage mechanism 324 from the sides of the running path, as shown in FIG. 12. The frame 301 is preferably deployed by the deployment mechanism 305, i.e., with a preloaded elastic element and its preloading cable and actuation and locking mechanisms as was described for the previous embodiments of the present invention. In the schematic of FIG. 12, a planar four-bar linkage mechanism 324 is used to achieve the motion to deploy the frame 301. The four-bar linkage mechanism 324 has links 317 and 318 with grounded rotating joints 319 and 320. The side 321 of the frame 301 is the coupler link of the four-bar linkage mechanism 324. In FIG. 12, the frame 301 is shown in its stored position (solid lines) with the linkage mechanism 324, in an intermediate position 322 and its fully deployed position 323. The safety net 104 is not shown in the frame of FIG. 12 for clarity.

In the schematic of FIG. 12, the simple planar four-bar linkage mechanism 324 is shown for achieving the aforementioned deployment motion. However, numerous other planar or spatial types of linkage mechanisms, which are well known in the art, may be used to achieve similar motions, which provide, for example, for faster and smoother deployment. In addition, the four-bar linkage mechanism 324 has one degree-of-freedom and is considered to be constructed with relatively rigid links and joints. However, linkage mechanisms with more than one degree-of-freedom may also be used. Alternatively, linkage mechanisms with relatively flexible links and living joints may also be used to construct the deployment mechanisms and achieve similar deployment motions. The more flexible mechanisms with more degrees-of-freedom would generally provide lighter deployment mechanisms and could be used to achieve faster and smoother deployment motion.

Figure 13:
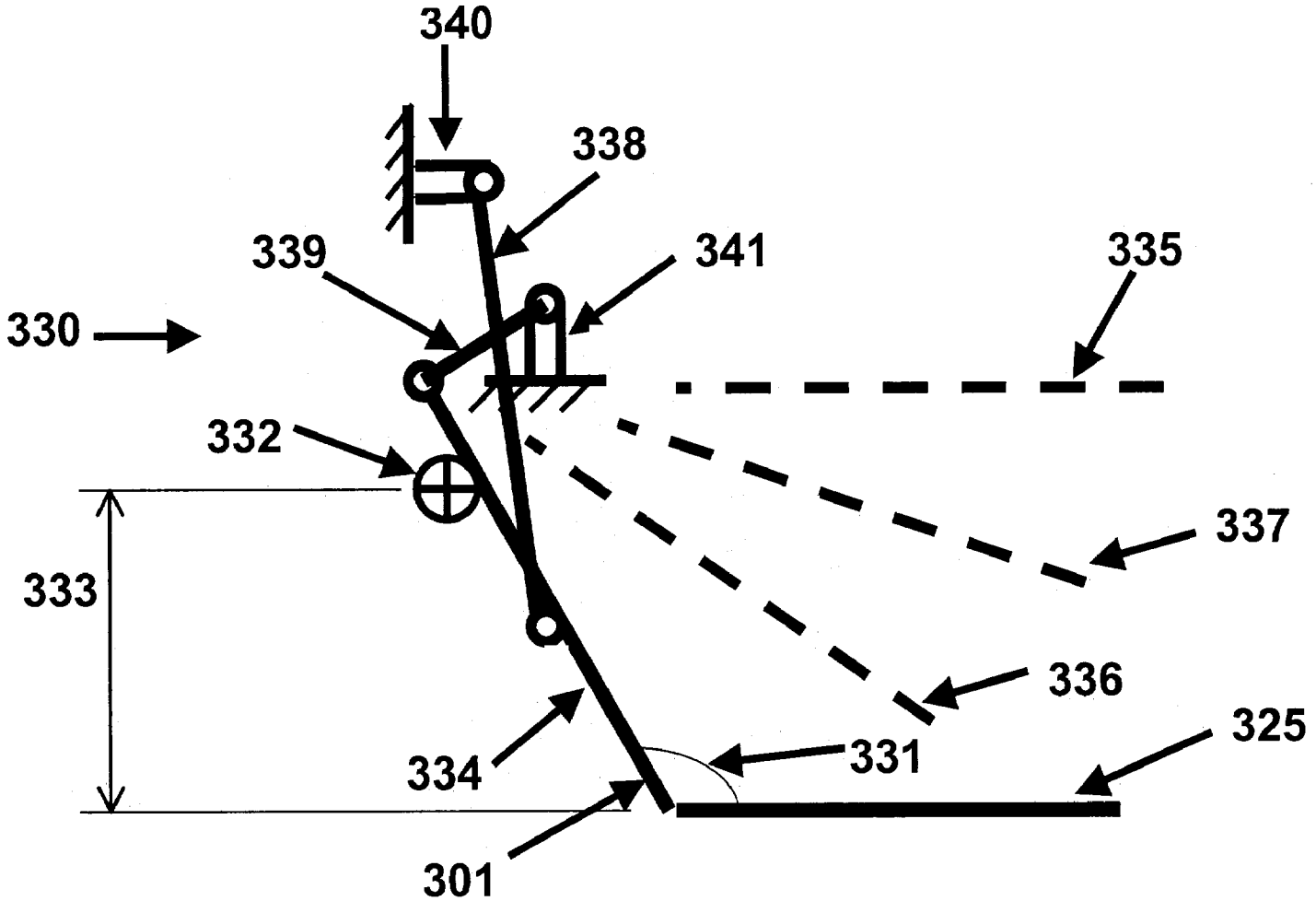
FIG. 13 illustrates a side view of another preferred implementation of a safety net deployment system.

Another embodiment of the present invention is shown in FIG. 13. In the schematic of FIG. 13, a view of the running path 325 and the safety net 104 attached to a frame 301 is shown looking in the running direction, towards the bar posts. Therefore in the view of FIG. 13, only the proximal edge of the safety net frame 301 is visible. In the present embodiment, the safety net frame 301 is deployed by one or more linkage mechanisms 330. The deployment linkage mechanism 330 shown in FIG. 13 consists of one or more planar linkage mechanisms, which are positioned along the length of the frame 301 (only one such mechanism is seen in the view shown in FIG. 13). In its stored position 334, the frame 301 is positioned away from the running path 325, preferably at an angle 331. In the stored position 334, the center of mass 332 of the frame 301 and all its associated moving parts are preferably positioned at a height 333 above the ground (hard) surfaces 22 to be covered. The height 333 is preferably close to the height that the center of mass 332 assumes in its deployed position 335. The purpose of keeping the center of mass 332 at nearly a level height is to minimize the amount of energy that is required to deploy the frame 301 and attached safety net 104 from its stored position 334. It is appreciated by those familiar with the art that that the angle 331 and the height 333 that the center of mass 332 assumes in its stored position 334 can be calculated to achieve a fast and smooth deployment with relatively small electric or pneumatic actuation devices.

The linkage mechanisms 330 deploys the frame 301 by rotating and translating it without tilting it in its longitudinal direction from its stored position 334 to its deployed position 335, through intermediate positions 336 and 337. The frame 301 is preferably deployed by the deployment mechanism 305 discussed above, i.e., with a preloaded elastic element and its preloading cable and actuation and locking mechanisms as was described for the previous embodiments of the present invention. In the schematic of FIG. 13, the linkage mechanism 330 is a planar four-bar linkage mechanism, which is used to achieve the aforementioned deploying motion of the frame 301. The four-bar linkage mechanism 330 has links 338 and 339 with grounded rotating joints 340 and 341. The visible side of the frame 301 is the coupler link of the four-bar linkage mechanism 330.

In the schematic of FIG. 13, the simple planar four-bar linkage mechanism 330 is used for achieving the aforementioned safety net deployment motion. However, numerous other planar or spatial types of linkage mechanisms, which are well known in the art, may be used to achieve similar motions, which provide, for example, for faster and smoother deployment. One particular variation of the four-bar linkage mechanism which may be used is a parallelogram mechanism in which the coupler link is the safety net frame 301, which can be used to deploy the safety net frame 301 with a motion that keeps the safety net 104 parallel to the ground (running path) at all times. In addition, the four-bar linkage mechanism 330 has one degree-of-freedom and is considered to be constructed with relatively rigid links and joints. However, linkage mechanisms with more than one degree-of-freedom may also be used. Alternatively, linkage mechanisms with relatively flexible links and living joints may also be used to construct the deployment mechanisms and achieve similar deployment motions. The more flexible mechanisms with more degrees-of-freedom would generally provide lighter deployment mechanisms, thereby making it possible to achieve faster and smoother deployment motion. Alternatively, different linkage or other types of mechanisms may be used to start the deployment of the frame 301 from some arbitrary stored position and bring it to the deployed position 335 using any arbitrary motions suitable for each particular application. Different deployment speeds and motions may be desired for different types of trainings and different levels of athlete competency.

Alternatively, a deployment linkage mechanism may be constructed which is a combination of the mechanisms shown in FIGS. 11 and 13, or a combination of those in FIGS. 12 and 13, as they are placed in series. The linkage mechanism shown in FIG. 13 may also be used to achieve the parallel motion of the safety net frame 311 shown in FIG. 10.

Figure 14:
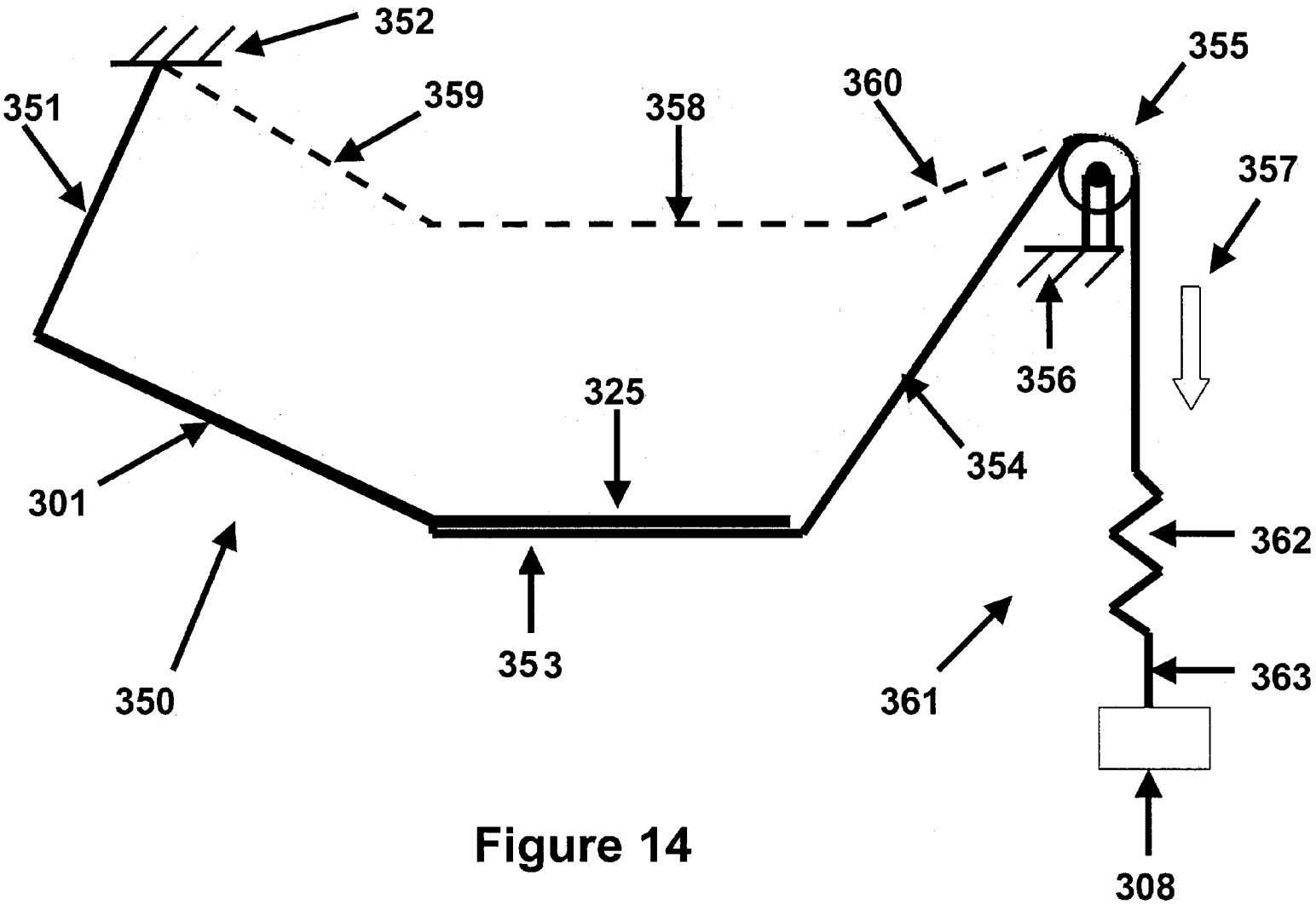
FIG. 14 illustrates a side view of another preferred implementation of a safety net deployment system.

Another embodiment of the present invention is shown in FIG. 14. In the schematic of FIG. 14, a view in the running direction 325 similar to that of FIG. 13 is shown. The safety net frame 301 is stored prior to deployment in position 350. In this embodiment, one side of the safety net frame 301 is fixed to the ground 352 (preferably a post, not shown) by at least one cable 351. The opposite side of the safety net frame 301 is attached to one or more cables marked 353 and 354. In its stored position, the segment 353 of this cable is stored in the recessed spaces 109 provided in the hard surfaces 22 (not shown). The segment 354 is passed over the pulley 355, which is fixed to the ground 356, preferably a post (not shown).

The frame 301 is preferably deployed by a deployment mechanism 361, which is very similar to that of deployment mechanism 305 discussed above. In the deployment mechanism 361, an elastic element 362 is preloaded by pulling the cable 363 by an electric or pneumatic actuation mechanism 308 as previously described for the embodiment of FIG. 10. During preloading, the segment of the cable 354 is locked in place by the locking (braking) mechanism 309 (FIG. 10), positioned just past the pulley 355 (not shown in FIG. 14). Once a deployment signal is received from the triggering mechanism and deployment control unit 102, the braking mechanism 309 is released, and the cable segment 354 is pulled over the pulley 355 in the direction 357 by the preloaded spring alone or by the preloaded spring together with the actuator 308, thereby moving the safety net frame 301 in its deployed position 358 over the hard surfaces 22 to be covered. In the deployed position 358 of the safety net frame 301, the cable segments 351 and 353 are in positions 359 and 360, respectively. In this embodiment, the cable segments 359 and 360 may be relatively elastic to provide for additional cushioning of a fall over the safety net 104. In the preferred implementation of this embodiment, a second safety net frame is symmetrically positioned on the opposite (right side, FIG. 14) of the running path similar to that shown in FIGS. 11 and 12.

In yet another embodiment of the present invention, the cable segments 351 or 354 are replaced by one of the linkage mechanisms of the previous embodiments shown in FIGS. 11–13. The preferred combination is the one, which is constructed by the linkage mechanism 330 on one side of the safety net frame 301 as shown in FIG. 13, and with the cable segments 353 and 354, together with the pulley 355 and the deployment mechanism 361 on the running path 325 side of the safety net frame 301.

In yet another embodiment of the present invention, a combination of sidewise deploying safety nets, FIGS. 10–14, and embedded safety nets, FIGS. 4–9, may be used. The purpose of such combinations may be to provide for higher reliability by providing for the deployment of more than one safety medium; it might be to provide for a more gradual resistance to fall (for example, the first barrier may be softer and the second one more stiff); it might be for the purpose of making each barrier and its components lighter, thereby making it possible to be deployed faster; or for two or more or these reasons. In addition, the deployment of the different safety nets 104 may be triggered by different sensors and when different events are detected, thereby providing for the best possible protection against each particular fall.

Figure 15:
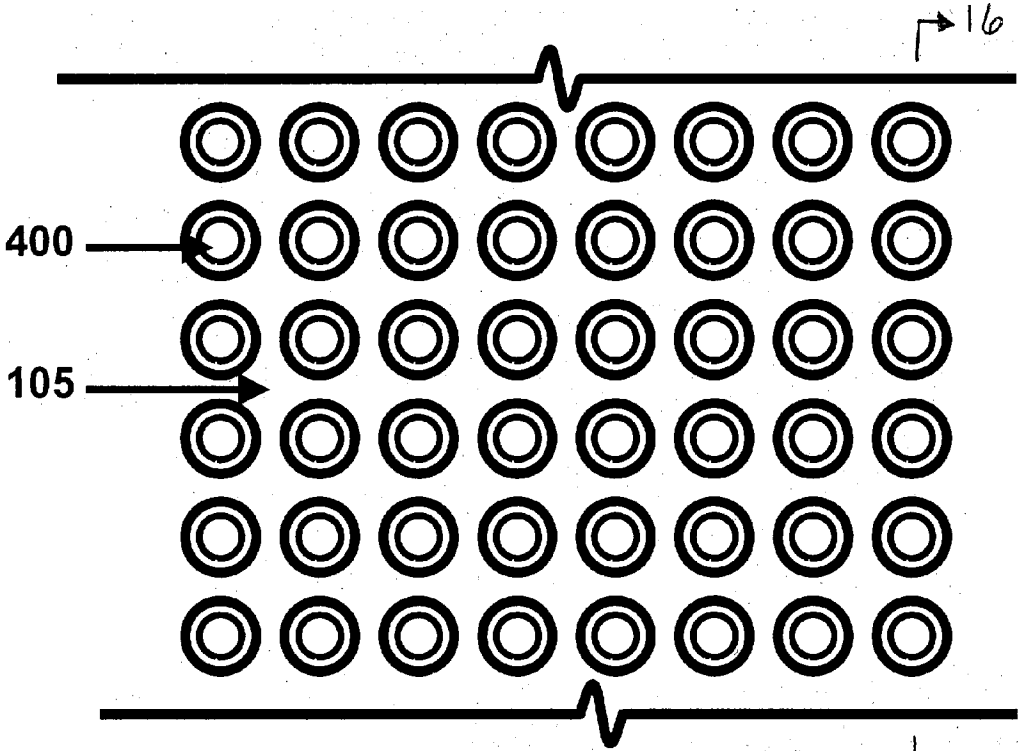
FIG. 15 illustrates a plan view of another preferred implementation of a deployment system having cushioning units.
Figure 16:
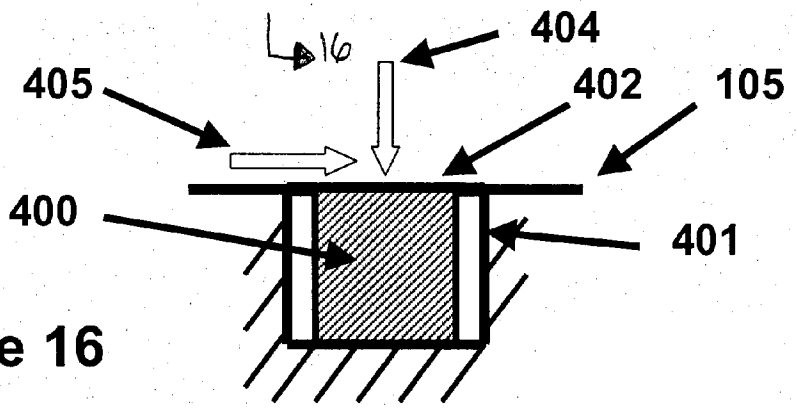
FIG. 16 illustrates a sectional view of a portion of the system of FIG. 15 as taken along line 16—16 in FIG. 15.

In yet another embodiment of the present invention, preloaded deployable fall cushioning units 400 are distributed over the hard surface areas 22, as shown in FIG. 15. The cushioning units 400 are embedded in spaces 401 provided in the hard surface areas as shown in the cross sectional view 16—16 in FIG. 16). In their retracted position as shown in FIG. 16, the top surface 402 of the cushioning units 400 provide a relatively rigid surface to render the running areas hard and appropriate for pole vaulting. However, in their deployed position, the fall cushioning units 400 substantially cover the hard surfaces 22, provide a relatively soft impact surfaces for a falling athlete, and provide the required axial flexibility characteristics to lower the impact forces to levels that prevent serious injury to the falling athlete.

Figure 17:
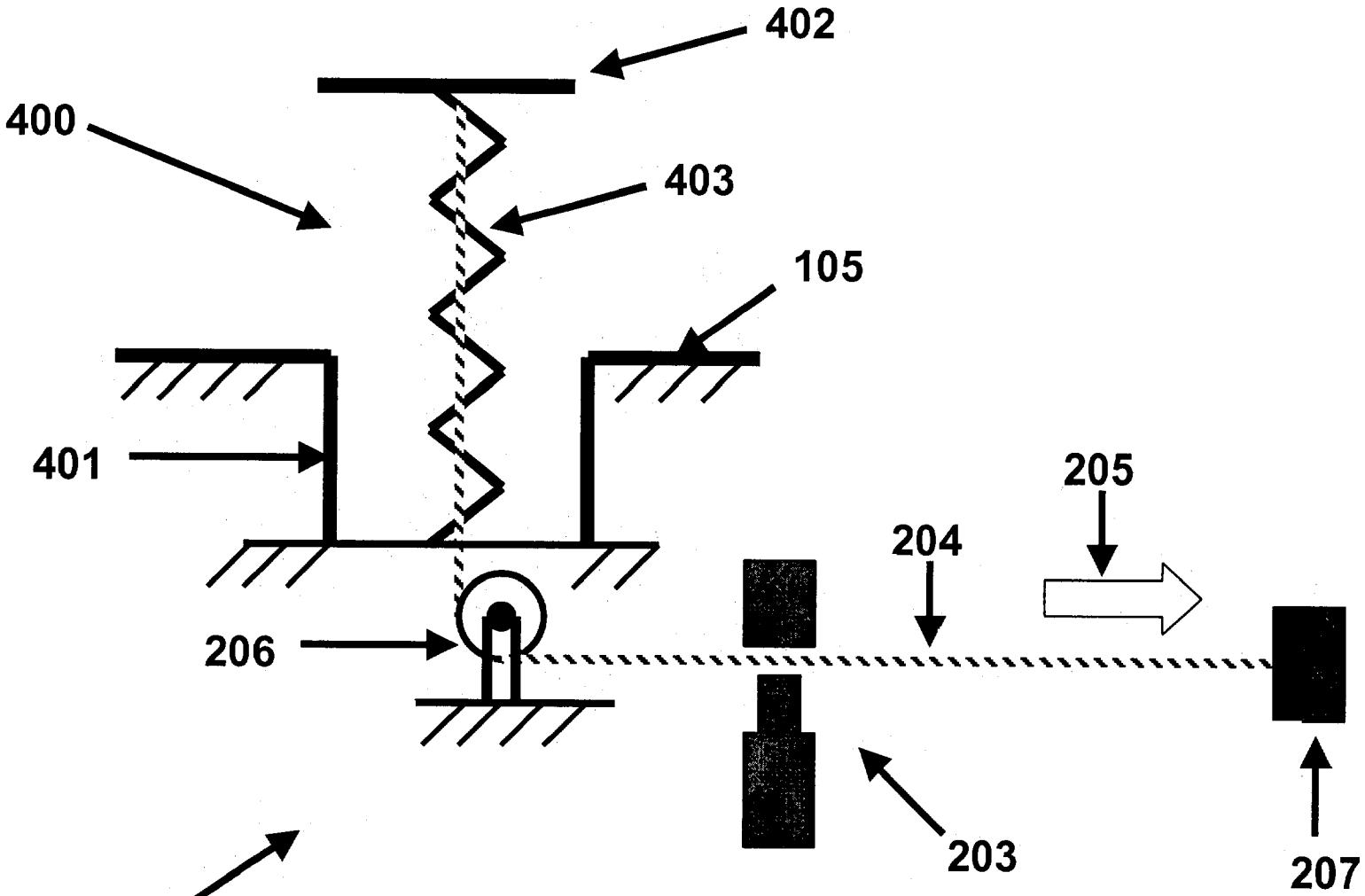
FIG. 17 illustrates a side schematic view of the system of FIG. 15.

The schematic of one embodiment of the cushioning unit 400 is shown in FIG. 17. The unit consists of a top 402, details of which is described below, an elastic element 403, which in its preloaded position brings the unit in its retracted position as shown in FIG. 16. The elastic element 403 not only serves as a fall cushioning element but also for fast deployment of the unit 400. The preloading of the elastic element 403 and the retraction of the top surface 402 are achieved by the preloading mechanism 202 and are similarly triggered for deployment both as described above with regard to the embodiment of FIG. 7.

Figure 18:
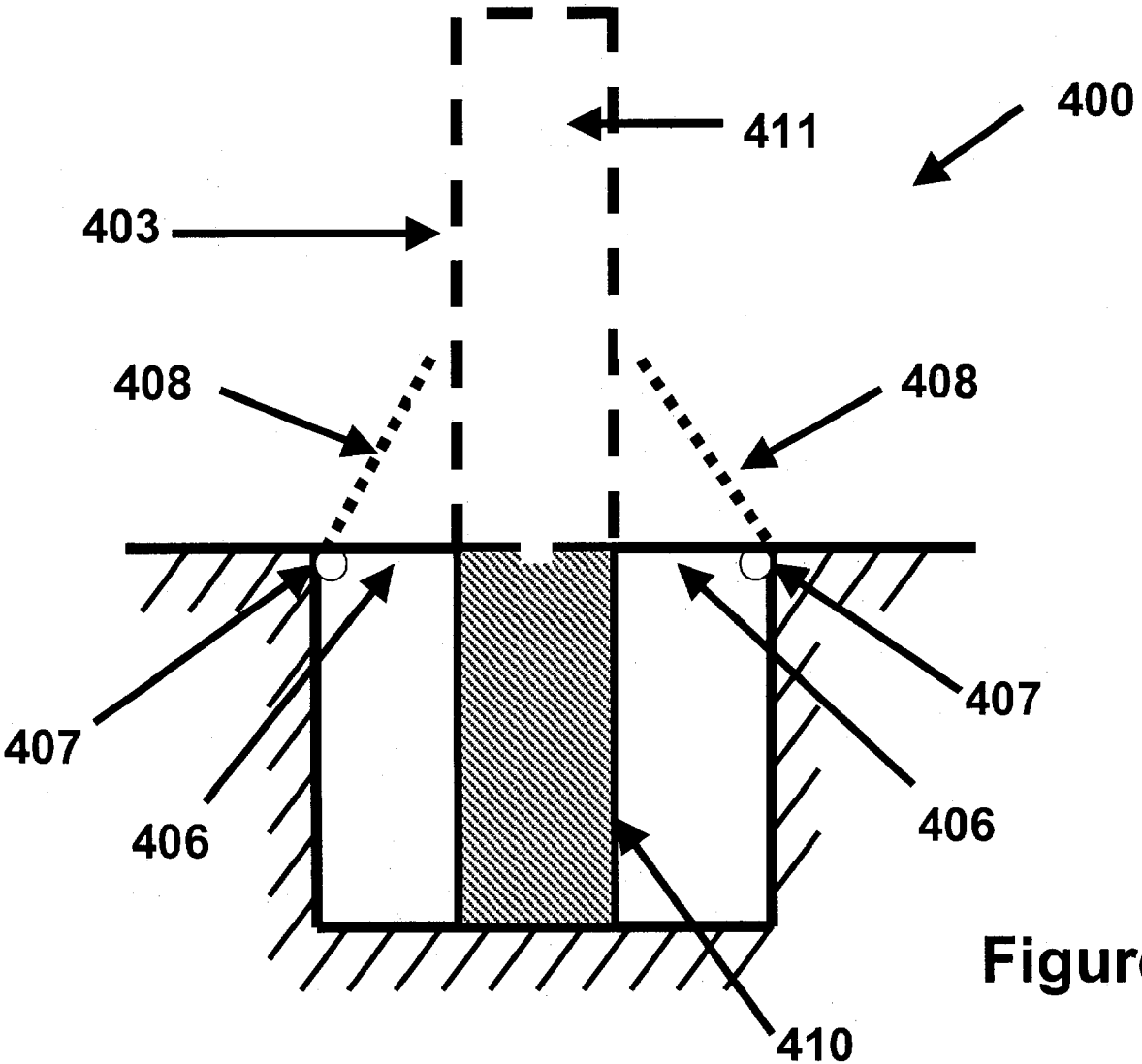
FIG. 18 illustrates an alternative configuration of the cross-section of FIG. 16.

In FIG. 17, for the sake of simplicity, the top piece 402 of the cushioning unit 400 is shown as it is in the retracted position of the cushioning unit (FIG. 16), in which case, it exhibits fairly rigid characteristics to the application of load on its top surface as the athlete steps on its surface. The load exerted by the athlete's foot on the top surface of the top piece 402 is primarily compressive, 404, with a smaller shearing force 405 (FIG. 16). In one embodiment of this invention, the top piece is constructed with one or more "leaves" 406 that are attached to the surfaces of 401 by hinges 407, and are biased by springs (not shown) to stay closed while the cushioning units 400 are in their retracted position. During the deployment of the units 400, the leaves 406 are forced open by the elastic element 403 as the unit is deployed from its retracted position 410 to its deployed position 411. The schematic of FIG. 18 shows a two leaf 406 design in closed (retracted) position and open (deployed) position 408 of the cushioning unit 400.

Figure 19:
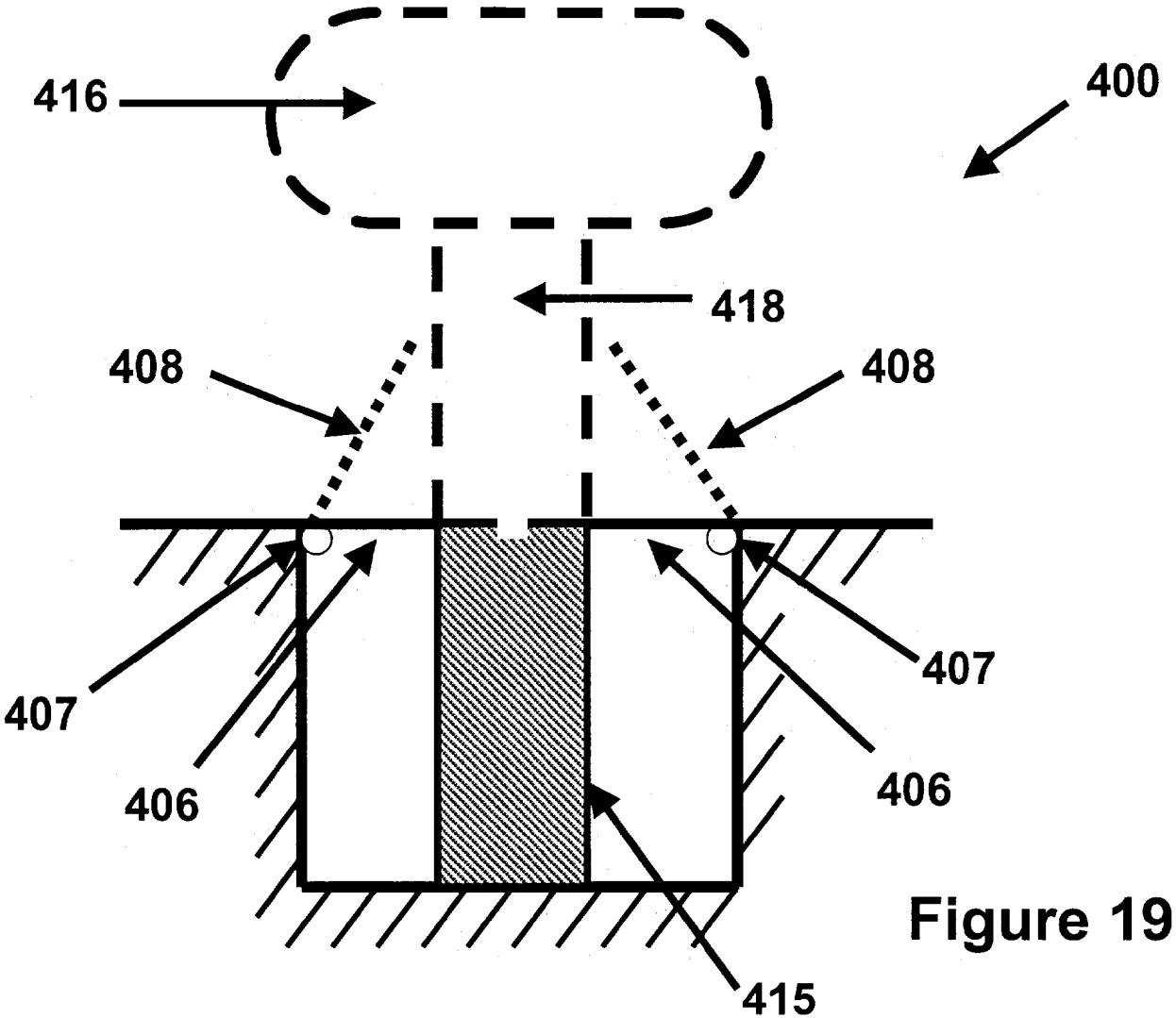
FIG. 19 illustrates another alternative configuration of the cross-section of FIG. 16.

In another embodiment of cushioning unit 400, the unit is constructed with elastic balloon like actuators 415, which are extended (deployed) by pressurized air or gas, position 418, the schematic of which is shown in FIG. 19. The top portion 416 of the balloons 415 is preferably made to expand laterally as the cushioning unit is deployed to cover the hard surfaces 22 completely and not allow a falling athlete to pass between adjacent balloons 415. This is accomplished by making the top portion 416 with thinner and thereby more extensible materials than the remaining lower portion of 415. As a result, as the balloon 415 is pressurized during deployment, the top portion 416 is expanded further to form a larger shape volume, with preferably nearly square surfaces to better cover the hard surfaces. Another method of enlarging the top portion 416 during deployment is to construct this portion with pleated elastic material that "collapse" inward as the balloon 415 is depressurized.

Figure 20:
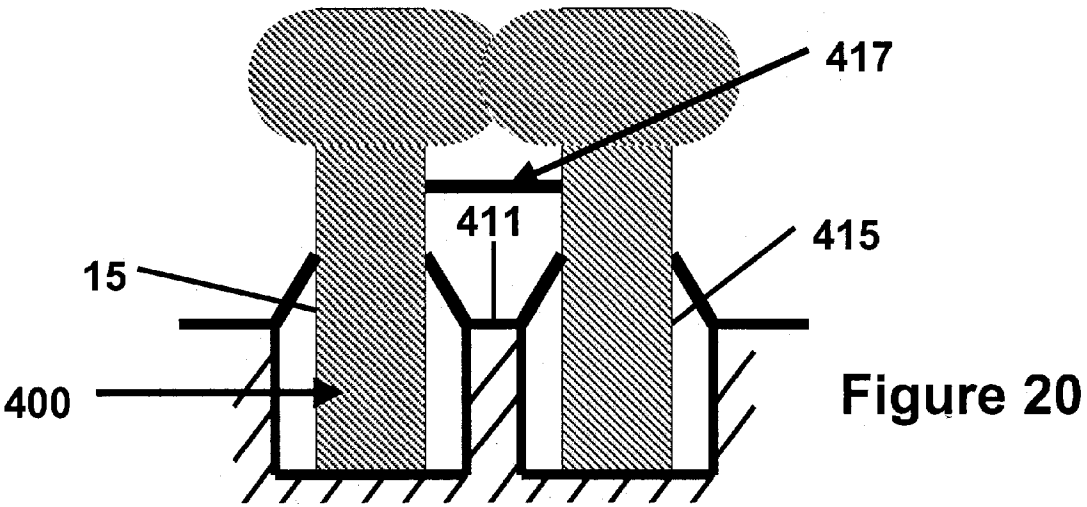
FIG. 20 illustrates yet another alternative configuration of the cross-section of FIG. 16.

In another embodiment of the cushioning units 400, adjacent balloons 415 are connected together by relatively elastic elements 417 to further prevent them from separating during a fall, as shown in FIG. 20. The elastic elements 417 are stored in recessed spaces 111 in the hard surfaces 22 while the cushioning units 400 are in retracted position.

Figure 21:
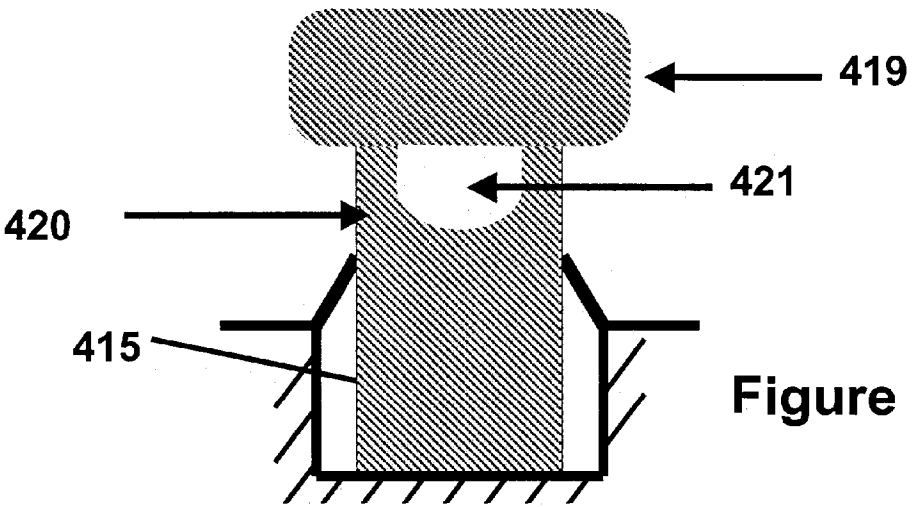
FIG. 21 illustrates yet another alternative configuration of the cross-section of FIG. 16.

In another embodiment, the top portions are airbags 419, which are deployed once the balloon like actuators 415 are deployed, as shown in FIG. 21. The airbags 419 are preferably stored in internal cavities 420 within the lower portion 421 of the actuators 415, and deploy up and out as the balloon actuators 415 are pressurized. The cavity 420 is preferably "cup" shaped to allow the airbag 419 to be readily deployed.

Figure 22:
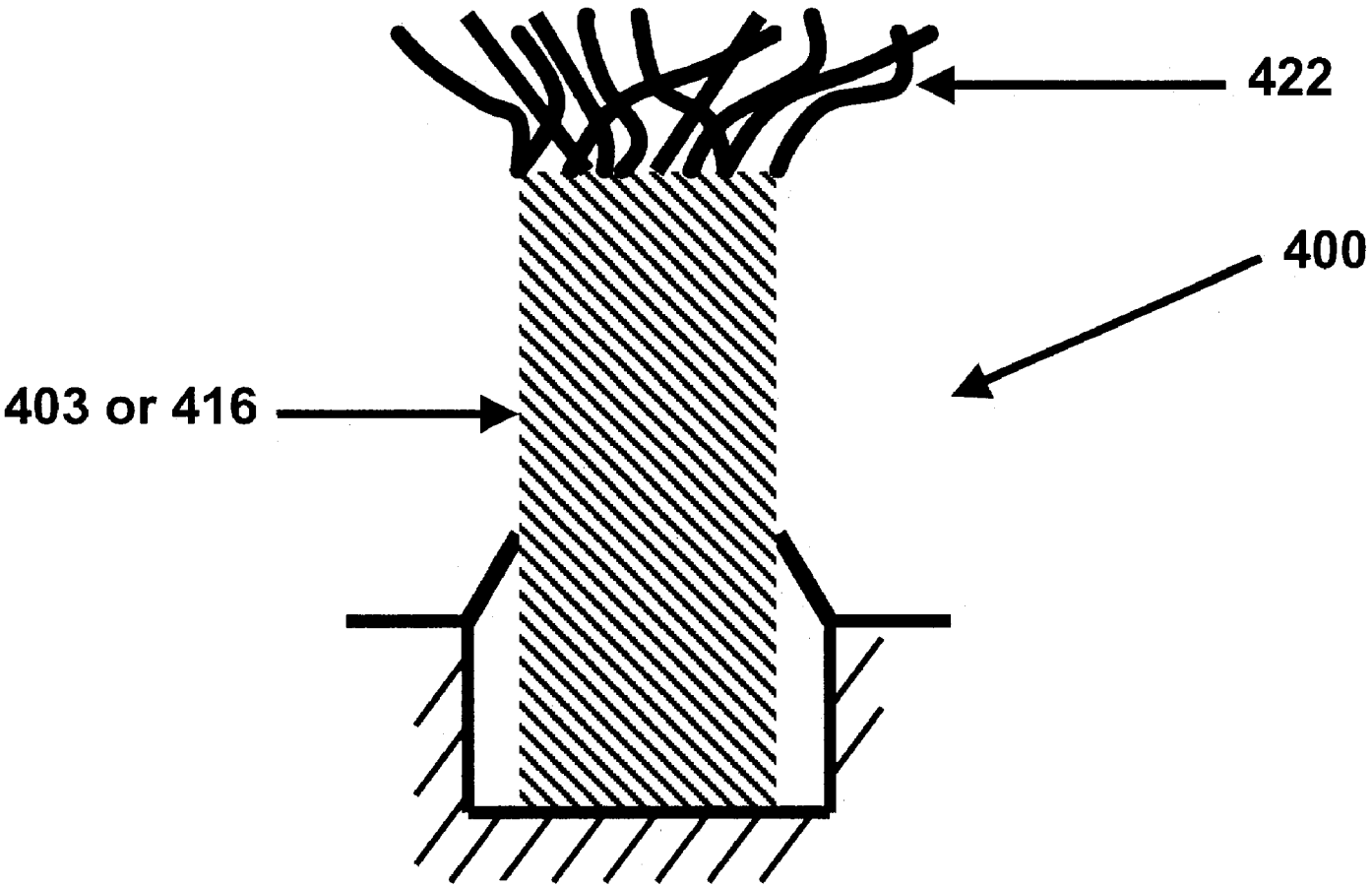
FIG. 22 illustrates still yet another alternative configuration of the cross-section of FIG. 16.

Referring now to FIG. 22, in yet another embodiment of the cushioning unit 400, the top portion of the elastic element 403 or the top portion 416 of the balloon like actuator is made from pieces of soft sponge type of material 422 that "bloom out" to cover the hard surfaces 22 as the cushioning units 400 are deployed.

In the aforementioned embodiments, the term safety net 104 is used to indicate the barrier material that is deployed above the surfaces over which an athlete may fall in a way that can cause injury, particularly a serious injury. The barrier material may actually be a net or loosely woven material or a solid film-like or woven material, such as a spandex type material. Part or all the materials used to fabricate the barrier material may be substantially elastic. The material may also be fabricated with such patterns and with one or more basic materials to achieve the desirable mechanical response characteristics suitable for the present application, i.e., to provide the required cushioning effect during a fall. The optimal mechanical response characteristic for a barrier material is that would provide relatively small resistance during initial, small area contact, such as during contact with the head in a fall on the head or a fall on one foot. The barrier material resistance should then gradually increase to its maximum as a larger portion of the body comes in contact with the barrier material. In general, the optimal mechanical response characteristic of the safety net is obtained by the combination of the mechanical response characteristics of the barrier material and all the other components of the safety net such as the frame, the elements connecting the barrier material to the frame, the cables and linkage and other types of mechanisms of the deployment mechanism, the preloading elastic elements, the braking (locking) elements, the connecting posts, ground connections, etc., that are used in the construction of the safety net system.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. An apparatus for preventing serious injuries to a person participating in a physical activity at least partially over a hard surface, the apparatus comprising:

at least one safety net being movable between deployed and retracted positions, wherein the at least one safety net substantially does not impede the physical activity while in the retracted position and cushions the person from falling onto the hard surface while in the deployed position;

detection means for detecting predetermined criteria indicative of a condition which requires deployment of the at least one safety net into the deployed position; and deployment means for deploying the at least one safety net over the hard surfaces upon detection of the predetermined criteria;

wherein the physical activity is pole-vaulting and the condition is a likelihood that the person will be injured by falling onto the hard surface, the detection means comprises one or more sensors for detecting the predetermined criteria and the one or more sensors comprises a vault box sensor operatively connected with a vault box for detecting the insertion of a pole therein for use in pole-vaulting.

2. The apparatus of claim 1, wherein the hard surfaces comprises a plurality of recesses for containing the safety net while in the retracted position.

3. The apparatus of claim 1, wherein the deployment means comprises a plurality of elastic elements operatively connected to each of the at least one safety net, preloading means for preloading the plurality of elastic elements to retain the at least one safety net in the retracted position, and releasing means for releasing the preloading on the plurality of elastic elements to deploy the safety net into the deployed position.

4. The apparatus of claim 1, wherein the deployment means comprises a movable frame for retaining the safety net and means for moving the movable frame back and forth between the retracted and deployed positions.

5. The apparatus of claim 4, wherein the movable frame is at least one of rotatable and translational between the retracted and deployed positions.

6. An apparatus for preventing serious injuries to a person participating in pole-vaulting at least partially over a hard surface, the apparatus comprising:

at least one safety net being movable between deployed and retracted positions, wherein the at least one safety net substantially does not impede the pole-vaulting while in the retracted position and cushions the person from falling onto the hard surface while in the deployed position;

deployment means for deploying the at least one safety net over the hard surfaces upon detection of a predetermined criteria; and a sensor for providing input into the deployment means, wherein the sensor comprises a vault box sensor operatively connected with a vault box for detecting the insertion of a pole therein for use with the pole-vaulting.

7. The apparatus of claim 6, further comprising detection means for detecting predetermined criteria indicative of a condition which requires deployment of the at least one safety net into the deployed position.

8. An apparatus for preventing serious injuries to a person participating in a physical activity at least partially over a hard surface, the apparatus comprising:

a material being movable between deployed and retracted positions, wherein the material substantially does not impede the physical activity while in the retracted position and cushions the person from falling onto the hard surface while in the deployed position;

one or more sensors for detecting predetermined criteria indicative of a condition which requires deployment of the material into the deployed position; and deployment means for deploying the material over the hard surfaces upon detection of the predetermined criteria;

wherein the one or more sensors comprises a vault box sensor operatively connected with a vault box for detecting the insertion of a pole therein for use in pole-vaulting.

* * * * *